US005252456A

United States Patent [19]

Ohshima et al.

[11] Patent Number: 5,252,456

[45] Date of Patent: Oct. 12, 1993

[54] SILVER HALIDE PHOTOGRAPHIC MATERIAL

[75] Inventors: Naoto Ohshima; Seiji Yamashita; Akira Kase, all of Kanagawa, Japan

[73] Assignee: Fuji Photo Film Co., Ltd., Kanagawa, Japan

[21] Appl. No.: 691,293

[22] Filed: Apr. 25, 1991

[30] Foreign Application Priority Data

Apr. 26, 1990 [JP] Japan ..... 2-111177
Apr. 26, 1990 [JP] Japan ..... 2-111179

[51] Int. Cl.[5] ..... G03C 1/09

[52] U.S. Cl. ..... 430/605; 430/604; 430/607; 430/611; 430/567

[58] Field of Search ..... 430/567, 377, 605, 604, 430/611, 607

[56] References Cited

U.S. PATENT DOCUMENTS 4,857,450 8/1989 Burrows et al. ..... 430/604
4,937,180 6/1990 Manchetti et al. ..... 430/604
5,057,402 10/1991 Shiba et al. ..... 430/604

*Primary Examiner*—Charles L. Bowers, Jr.
*Assistant Examiner*—Thorl Chen
*Attorney, Agent, or Firm*—Sughrue, Mion, Zinn, Macpeak & Seas

[57] ABSTRACT

Disclosed is (1) a silver halide photographic material having at least one light-sensitive emulsion layer containing a silver halide emulsion on a support, wherein the light-sensitive emulsion layer comprises silver halide grains which contain at least one complex selected from the group consisting of Ir and Pt metal complexes having at least two cyan ligands which have a silver chloride content of 80 mol % or more and do not substantially contain silver iodide and which have a silver bromide-rich localized phase with a silver bromide content of 10 mol % or more, and (2) a silver halide photographic material having at least one light-sensitive emulsion layer containing a silver halide emulsion on a support, wherein the light-sensitive emulsion layer comprises silver halide grains which contain at least one complex selected from the group consisting of Ir and Pt metal complexes having at least two cyan ligands, which have a silver chloride content of 80 mol % or more and which are gold-sensitized.

4 Claims, No Drawings

SILVER HALIDE PHOTOGRAPHIC MATERIAL

FIELD OF THE INVENTION

The present invention relates to a silver halide photographic material and, more precisely, to that which has an excellent rapid processability and a high sensitivity. The material is free from fluctuation of sensitivity gradation caused by variation of the intensity of the light applied for exposure and is also free from fluctuation of sensitivity caused by variation of the time from exposure to processing. The material is hardly fogged under pressure.

BACKGROUND OF THE INVENTION

Various kinds of silver halide photographic materials have been commercially sold in the market and various methods of processing them for image formation have been known. Such materials are therefore utilized in various fields. The halogen composition of silver halide emulsions constituting these various photographic materials is in many cases, especially in the case of picture-taking photographic materials, a silver iodobromide consisting essentially of silver bromide, since the materials are desired to have a high sensitivity.

On the other hand, in the case of photographic materials for color photographic paper products which are used in the market where a large amount of color prints are desired to be processed and finished in a short period of time for delivery to the consumers and users, a silver bromide or silver chlorobromide which does not substantially contain silver iodide is used in the emulsions because of the necessity of accelerating the speed of development thereof.

Recently, the request for improvement of rapid processability of color photographic papers is increasing more and more, and many studies thereof have been made. For instance, it is known that elevation of the silver chloride content in a silver halide emulsion brings about noticeable improvement of the developability of the resulting emulsion.

However, it is known that a high silver chloride emulsion could hardly have a high sensitivity to give a hard gradation. Additionally, it is also known that the emulsion has the drawback of a large reciprocity law failure. That is, variation of the intensity of light to be applied to the emulsion for exposure causes great fluctuation of sensitivity and gradation of the emulsion.

In order to overcome the above-mentioned drawbacks of such a high silver chloride emulsion, various techniques have been illustrated.

For instance, JP-A-58-95736, JP-A-58-108533, JP-A-60-222844 corresponding to U.S. Pat. No. 4,590,155, JP-A-60-222845 corresponding to U.S. Pat. No. 4,605,610 and JP-A-64-26837 corresponding to U.S. Pat. Nos. 4,820,624 and 4,865,962 (the term "JP-A" as used herein means an "unexamined published Japanese patent application") illustrate various high silver chloride emulsions with various silver bromide-rich regions of various structures which have high sensitivity to give hard images. However, after repeated investigations made by the present inventors, it has been found that high silver chloride emulsions prepared by the illustrated techniques often cause desensitization under pressure, though they are highly sensitive in the absence of pressure. Therefore, the emulsions have a severe drawback for practical use. In addition, it has also been found that the reciprocity law failure of high silver chloride emulsions could not fully be overcome by the illustrated techniques.

In order to overcome the reciprocity law failure of silver halide emulsions, doping of an Ir complex having a halogen as a ligand is known to be effective. For instance, JP-B-43-4935 (the term "JP-B" as used herein means an "examined Japanese patent publication") mentions that a photographic material having a silver halide emulsion which contains a slight amount of an iridium compound as added during precipitation or ripening of silver halide grains in the emulsion gives an image having an almost constant gradation even when the exposure time is varied in a broad range. However, H. Zwicky (*Journal of Photographic Science,* Vol. 33, page 201) mentions that exposure of a chlorine ligand-doped high silver chloride emulsion is accompanied by intensification of the formed latent image in the period of from 15 seconds to about 2 hours after the exposure. Such intensification unfavorably causes fluctuation of the sensitivity of the exposed emulsion, depending upon the variation of the time from exposure to processing. Therefore, this emulsion is inconvenient from a practical standpoint.

JP-A-1-105940 corresponding to EP 312994A mentions that a high silver chloride emulsion having a selectively iridium-doped silver bromide-rich region has an excellent reciprocity law characteristic without interfering with the latent image stability for several hours after exposure. However, in accordance with the illustrated technique, overcoming of the reciprocity law failure of a pure silver chloride emulsion is impossible, and variation of the reaction condition in forming the silver bromide-rich region often causes sensitization of latent images formed Because of these reasons, further improvement of the proposed technique is desired.

JP-A-2-20853 corresponding to U.S. Pat. No. 4,945,035 mentions that doping of a high silver chloride emulsion with an Re, Ru or Os six-coordinate complex having at least four cyan ligands is effective for elevation of the sensitivity of the doped emulsion However, as a result of repeated studies by the present inventors on the illustrated technique, it has been clarified that the photographic material having the doped emulsion is often fogged under pressure during development of the material with a developer, though the sensitivity of the emulsion could surely be elevated by the illustrated technique. Because of this drawback, however, the emulsion is practically useless.

SUMMARY OF THE INVENTION

The object of the present invention is to provide a silver halide photographic material which has an excellent rapid processability and a high sensitivity, which is free from fluctuation of sensitivity gradation caused by variation of the intensity of the light applied for exposure and is also free from fluctuation of sensitivity caused by variation of the time from exposure to processing, and which is hardly fogged under pressure.

The above and other objects and advantages of the present invention have been attained by a further improvement of a silver halide photographic material having at least one light-sensitive emulsion layer containing a silver halide emulsion on a support, wherein the light-sensitive emulsion layer comprises silver halide grains which contain at least one complex selected from the group consisting of Ir and Pt metal complexes having at least two cyano ligands and which have a silver chloride content of 80 mol % or more.

More precisely, it has been attained by (1) a silver halide photographic material having at least one light-sensitive emulsion layer containing a silver halide emulsion on a support, wherein the light sensitive emulsion layer contains substantially silver iodide-free silver halide grains which contain at least one complex selected from the group consisting of Ir and Pt metal complexes having at least two cyano ligands and which have a silver chloride content of 80 mol % or more and have a silver bromide-rich localized phase with a silver bromide content of 10 mol % or more or by (2) a silver halide photographic material having at least one light-sensitive emulsion layer containing a silver halide emulsion on a support, wherein the light-sensitive emulsion layer contains gold-sensitized silver halide grains which contain at least one complex selected from the group consisting of Ir and Pt metal complexes having at least two cyan, ligands and which have a silver chloride content of 80 mol % or more.

DETAILED DESCRIPTION OF THE INVENTION

Ir and Pt metal complexes to be used in the present invention must have at least two cyano ligands. However, in order to more efficiently attain the effect of the present invention, the metal complexes are desired to have at least four cyano ligands, most preferably at least six cyan ligands. As ligands other than cyan, (CN) ligands in the metal complexes, for example, Cl, Br, I, $N_3$, and $H_2O$ can be used.

Specific examples of Ir and Pt metal complexes having at least two cyano ligands, which are used in the present invention, are mentioned below. As pair ions to these metal complexes, for example, ammonium ion and alkali metal ions such as sodium and potassium ions are preferred.

$[Ir(CN)_6]^{-3}$
$[Ir(CN)_5Cl]^{-3}$
$[Ir(CN)_4Cl_2]^{-3}$
$[Ir(CN)_5Br]^{-3}$
$[Ir(CN)_4Br_2]^{-3}$
$[Ir(CN)_5I]^{-3}$
$[Ir(CN)_4I_2]^{-3}$
$[Ir(CN)_5(N_3)]^{-3}$
$[Ir(CN)_5(H_2O))]^{-2}$
$[Pt(CN)_4]^{-2}$
$[Pt(CN)_4Cl_2]^{-2}$
$[Pt(CN)_4Br_2]^{-2}$
$[Pt(CN)_4I_2]^{-2}$

In the light-sensitive emulsion layer of constituting the photographic material of the present invention, the total content of at least one complex selected from the group consisting of Ir and Pt metal complexes having at least two cyan ligands is preferably from about $1\times10^{-6}$ mol to about $1\times10^{-3}$ mol, more preferably from $5\times10^{-6}$ mol to $5\times10^{-4}$ mol, per mol of silver halide.

The at least one complex selected from the group consisting of Ir and Pt metal complexes having at least two cyano ligands, contained in the silver halide grains used in the present invention, may be added to the silver halide emulsion at any stage of forming the silver halide grains therein, or at any stage before, during or after formation of silver halide nuclei, growth of the nuclei, physical ripening of the grown grains or chemical sensitization of the grains. It may be added to the emulsion all at a time or portionwise several times. However, it is preferred that 50% or more of the total content of at least one selected from the group consisting of Ir and Pt metal complexes having at least two cyan ligands contained in the silver halide grains is in the surface layer of 50% or less of the grain volume. The wording "surface layer of 50% or less of grain volume" as referred to herein means the surface part which corresponds to 50% or less of the volume of one grain. The volume of the surface layer is preferably 40% or less, more preferably 20% or less, of the grain volume. If desired, the silver halide grains in the emulsion may have an additional layer not containing the metal complex over the surface layer containing the particularly defined metal complex(es).

For incorporating the metal complex(es) into silver halide grains, it is preferred to first dissolve the metal complex(es) in water or any other pertinent solvent and then to directly add the resulting solution to the reaction system for forming silver halide grains, or alternatively, to first add the metal complex(es) to an aqueous halide solution, an aqueous silver salt solution and/or any other solution(s) for forming silver halide grains prior to formation of the grains. As another preferred means, fine silver halide grains which already contain the metal complex(es) are added to and dissolved in the reaction system for forming silver halide grains so that the fine grains are deposited on the other grains so as to incorporate the necessary metal complex(es) into the grains.

Regarding the halogen composition of the silver halide grains used in the silver halide photographic material, it is necessary that the grains are substantially silver iodide-free silver chlorobromide or silver chloride grains in which 80% or more of the total silver halide constituting the grain is silver chloride. In the silver halide photographic material (2), the silver halide grains preferably have a silver bromide-rich localized phase. The wording "substantially silver iodide-free grain" as referred to herein means that the silver iodide content in the grain is 1.0 mol % or less. As the preferred halogen composition in the silver halide grains for use in the present invention, the grains are substantially silver iodide-free silver chlorobromide or silver chloride grains in which 95 mol % or more of the total silver halide of constituting the grain is silver chloride. As the preferred halogen composition in the silver halide grains for use in the present invention, the grains are substantially silver iodide-free silver chlorobromide or silver chloride grains in which 99 mol % or more of the total silver halide constituting the grain is silver chloride.

It is desired that the silver halide grains of the present invention have a localized phase having a silver bromide content of more than at least 10 mol %. Regarding the position of such a high silver bromide content having a localized phase in the grains, it is desired that the localized phase is near the surface of the grain in order to more efficiently attain the effect of the present invention and in view of the pressure-resistance of the photographic material containing the grains and protection of the material from the dependence of the composition of the processing solution to be applied to the material. The wording "near the surface of grain" as referred to herein indicates the position of 1/5 or less, preferably 1/10 or less, of the grain size of the grain from the outermost surface thereof. As the most preferred arrangement of the localized phase having a high silver bromide content, the localized phase having a silver bromide content of more than at least 10 mol % grows on the corners of cubic or tetradecahedral silver chloride grains by epitaxial growth.

It is necessary that the silver bromide content in the silver bromide-rich localized phase is more than 10 mol %. However, if the silver bromide content in the phase is too high, such a high silver bromide content in the localized phase would cause desensitization of the emulsion under pressure or would cause noticeable fluctuation of the sensitivity or gradation by variation of the composition of the processing solution, if any. Incorporation of the localized phase with such a high silver bromide content into the silver halide grains of the present invention is unfavorable as it gives some undesirable photographic properties to the grains. Accordingly, in consideration of these points, the silver bromide content in the silver bromide-rich localized phase is preferably from about 10 to about 60 mol %, most preferably from 20 to 50 mol %. The silver bromide content of the silver bromide-rich localized phase may be analyzed by an X-ray diffraction method (for example, as described in *Lecture of New Experimental Chemistry,* No. 6, Analysis of Structure, edited by Japan Chemical Society, published by Maruzen Publishing Co., Japan). It is desired that the silver bromide-rich localized phase is composed of silver of from about 0.1 to about 20%, more preferably from 0.2 to 5%, of the total silver of constituting the silver halide grains of the present invention.

The interface between the silver bromide-rich localized phase and other phases in the silver halide grains of the present invention may have a distinct boundary therebetween or may also have a transition region where the silver composition gradually varies.

For forming such a silver bromide-rich localized phase in the silver halide grains of the present invention, various methods may be employed. For instance, a soluble silver salt and soluble halide(s) may be reacted by a single jet method or a double jet method to form the intended localized phase. Alternatively, a conversion method in which already formed silver halide grains are converted into other silver halide grains having a lower solubility product may also be employed for forming the intended localized phase in the grains. However, the most preferred method of forming the localized phase is such that cubic or tetradecahedral silver halide host grains are blended with other fine silver halide grains having a smaller mean grain size and a higher silver bromide content than the host grains and the resulting blended grains are then ripened to form the intended silver bromide-rich localized phase in the resulting grains. This is the most preferred embodiment which can efficiently attain the effect of the present invention.

It is also preferred to incorporate at least one complex selected from the group consisting of Ir and Pt metal complexes having at least two cyano ligands into the silver bromide-rich localized phase, i.e., to carry out the formation of the localized phase in the presence of such metal complex(es). The step of "forming the localized phase in the presence of metal complex(es)" as referred to herein is to supply the necessary metal complex(es) to the reaction system simultaneously with or immediately before or after the supply of silver and halogen for forming the localized phase. Where the silver bromide-rich localized phase is formed by ripening the blend comprising the silver halide host grains and the fine silver halide grains having a smaller mean grain size and a higher silver bromide content than the host grains, it is preferred that one or more of the metal complexes are previously incorporated into the high silver bromide content having fine silver halide grains.

It is preferred that the silver halide grains of the present invention are chemically sensitized, for example, by any one of sulfur sensitization, selenium sensitization, reduction sensitization, gold sensitization and noble metal sensitization or a combination of two or more. Above all, sulfur sensitization, gold sensitization and gold-sulfur sensitization are more preferred. Especially preferred is gold sensitization.

Where the grains are chemically sensitized with sulfur, sulfur-containing compounds capable of reacting with active gelatin or silver (for example, thiosulfates, thioureas, mercapto compounds, rhodanines) are employed. Specific examples of such compounds usable in sulfur sensitization are described in U.S. Pat. Nos. 1,574,944, 2,278,947, 2,410,689, 2,728,668 and 3,656,955.

The silver halide grains of the present invention may be those having (100) plane on the outer surface or those having (111) plane thereon, or may also be those having both planes or those having higher order plane(s). Preferably, the grains are cubic or tetradecahedral grains essentially having (100) plane.

The grain size of the silver halide grains of the present invention may fall within a range of general grains. Preferably, the grains of the invention have a mean grain size of from about 0.1 μm to about 1.5 μm.

Regarding the grain size distribution of the emulsion, either a polydispersed emulsion or a monodispersed emulsion may be employed in the present invention. However, the latter monodispersed emulsion is preferred. The grain size distribution expressing the degree of monodispersion of emulsions is represented by the statistical ratio (s/d) of the standard deviation (s) to the mean grain size (d). The emulsions of the present invention are preferably those having the ratio (s/d) of about 0.2 or less, more preferably 0.15 or less. Preferably, two or more monodispersed emulsions of different kinds may be blended for use in the present invention.

Preferably, the silver halide grains of the present invention may contain other metal complexes or metal salts mentioned below, in addition to the essential Ir or Pt metal complexes having at least two cyan ligands, for the purpose of further reducing the fluctuation of the sensitivity and gradation caused by variation of the intensity of light for exposure.

Such complexes and salts include, for example, hexachloroiridates(III) or (IV), hexaaminoiridates(III) or (IV), trioxalatoiridates(III) or (IV), hexacyanoferrites(II) or ferrates(III), and ferrous or ferric thiocyanates.

The amount of the above-mentioned iridium ion to be added is preferably from about $1\times10^{-9}$ mol to about $1\times10^{-6}$ mol, most preferably from $1\times10^{-8}$ mol to $1\times10^{-6}$ mol, per mol of silver halide. The amount of the above-mentioned iron ion to be added is preferably from about $1\times10^{-8}$ mol to about $1\times10^{-4}$ mol, most preferably from $1\times10^{-7}$ mol to $1\times10^{-4}$ mol, per mol of silver halide.

It is preferred that the light-sensitive emulsion layer of the present invention contains at least one compound of the following general formulae (I), (II) and (III). The amount of the compound(s) to be added to the layer is preferably from about $1\times10^{-5}$ mol to about $5\times10^{-2}$ mol, most preferably from $1\times10^{-4}$ mol to $1\times10^{-3}$ mol, per mol of the silver halide in the layer.

The compounds may be added at any stage before coating of the layer. For instance, they may be added to the emulsion during formation of the silver halide grains, before initiation of post-ripening of the emulsion, after completion of post-ripening thereof, or during preparation of the coating composition.

General formulae (I), (II) and (III) are set forth below.

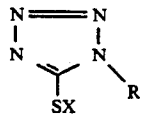

(I)

where R represents an alkyl group, an alkenyl group, or an aryl group; and X represents a hydrogen atom, an alkali metal atom, an ammonium group, or a precursor.

The alkyl group represented by R has from 1 to 20 carbon atoms and preferably from 1 to 12 carbon atoms, the alkenyl group represented by R has from 3 to 20 carbon atoms and preferably from 3 to 12 carbon atoms and the aryl group represented by R has from 6 to 20 carbon atoms and preferably from 6 to 15 carbon atoms.

The alkali metal atom of X includes, for example, sodium atom and potassium atom; the ammonium group of X includes, for example, tetramethylammonium group and trimethylbenzylammonium group, and the precursor of X is a group which may be a hydrogen atom or an alkali metal atom under an alkaline condition and it includes, for example, acetyl group, cyanoethyl group and methanesulfonylethyl group.

The alkyl or alkenyl group of R may be either substituted or unsubstituted, and may be alicyclic. Substituents which may be in the substituted alkyl group are, for example, a halogen atom, a nitro group, a cyano group, a hydroxyl group, an alkoxy group, an aryl group, an acylamino group, an alkoxycarbonylamino group, an ureido group, n amino group, a heterocyclic group, an acyl group, a sulfamoyl group, a sulfonamido group, a thioureido group, a carbamoyl group, an alkylthio group, an arylthio group, a heterocyclic-thio group, as well as a carboxylic acid group, a sulfonic acid group and salts thereof.

The above-mentioned ureido group, thioureido group, sulfamoyl group, carbamoyl group and amino group may be unsubstituted, N-alkyl-substituted or N-aryl-substituted. Examples of the aryl moiety of the N-aryl-substituted groups include an unsubstituted phenyl group and a substituted phenyl group. Substituents of the substituted phenyl group include an alkyl group as well as the above-mentioned substituents of the substituted alkyl group.

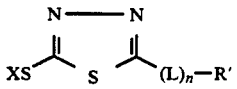

(II)

where L represents a divalent linking group: R' represents a hydrogen atom, an alkyl group, an alkenyl group, or an aryl group. The alkyl and alkenyl groups of R' and X have the same meanings as those in formula (I).

As specific examples of the divalent linking group or L, there are mentioned

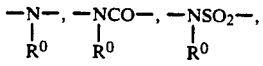

-continued

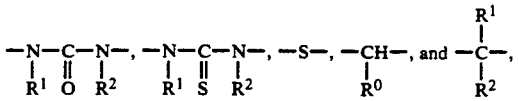

and combination of two or more of these groups.

n represents 0 or 1; and $R^0$, $R^1$ and $R^2$ each represent a hydrogen atom, an alkyl group, or an aralkyl group.

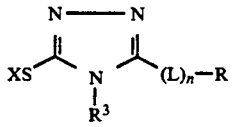

(III)

where R and X have the same meaning as those in formula (I); L has the same meaning as that in formula (II); $R^3$ has the same meaning as R and the former may be different from the latter.

Specific examples of compounds of formulae (I), and (III) are mentioned below, which, however, are not limitative.

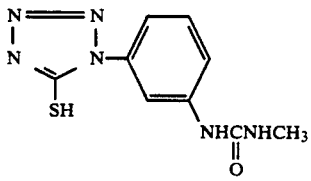

(I-1)

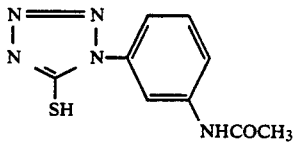

(I-2)

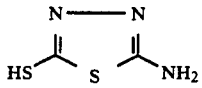

(II-1)

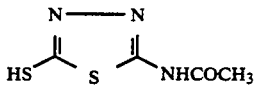

(II-2)

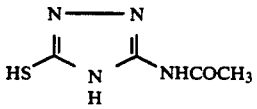

(III-1)

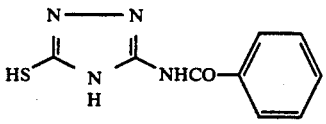

(III-2)

It is preferred that the silver halide grains of the present invention are formed in the presence of gelatin, an aqueous 16 wt % solution of which has a transmittance at 450 nm of 50% or more, preferably 65% or more, especially preferably 80% or more.

The transmittance of an aqueous 16 wt % solution of gelatin at 450 nm is measured with a commercial spectrophotometer with reference to the transmittance of pure water under the same condition.

The above-mentioned gelatin is used in the step of forming the silver halide grains of the emulsion constituting the photographic material of the present invention, and it may also be used preferably in any other step of preparing the material, for example, in the step of re-dispersing the grains after precipitation and de-salting, in the step of post-ripening the grains or in the step of preparing a complete emulsion just before coating.

Where the photographic material of the present invention is one having two or more light-sensitive layers optionally along with non-light-sensitive layers, the gelatin of the type may also be used in any light-sensitive layer or non-light-sensitive layer in addition to the layer containing the particular emulsion of the invention.

The gelatin of the kind to be used in the present invention may be any gelatin prepared by any manufacture step or purification step, provided that the transmittance satisfies the above-mentioned conditions. For instance, it may be a conventional gelatin selected from alkali-processed gelatin, acid-processed gelatin, enzyme-processed gelatin, gelatin derivatives and modified gelatins. Treatment or purification of gelatin for the purpose of increasing the transmittance may be effected at any stage prior to application of the gelatin to formation of the silver halide grains.

Accordingly, for example, the gelatin powder used in formation of the silver halide grains of the invention may already have a transmittance to satisfy the defined condition. Alternatively, some treatment may be applied to a gelatin powder so that the powder has a transmittance satisfying the defined condition at any stage prior to application of the gelation to formation of the silver halide grains of the invention.

The gelatin to be used in formation of the silver halide grains of the present invention is preferably purified previously by any one of the following means or by a combination.

(1) The solution of gelatin is treated with an active charcoal.

(2) The gelatin is washed with a cold water (15° C. or lower).

(3) The gelatin is subjected to gel permeation chromatography to elevate the transmittance.

By single, repeated or combined application of the above-mentioned purification means, gelatin originally having a transmittance of 50% or less may be purified to a transmittance of 50% or more.

Color sensitization (spectral sensitization) is effected for the purpose of imparting the color sensitivity in the desired light wavelength range to the emulsions of the respective layers of the photographic material of the present invention. In accordance with the present invention, such color sensitization is preferably effected by adding a dye (color-sensitizing dye) which absorbs the light with a wavelength range corresponding to the intended spectral sensitivity (color sensitivity) to the photographic emulsion. As examples of the color-sensitizing dyes usable for this purpose, the compounds described in F. M. Harmer, *Heterocyclic Compounds—Cyanine Dyes and Related Compounds* (published by John Wiley & Sons Co. of New York, London, in 1964) are referred to. Specific examples of such compounds and color sensitization methods are described in JP-A-62-215272, pages 22 (upper right column) to 38, and these are preferably employed in the present invention.

The silver halide emulsion for use in the present invention can contain various compounds or precursors thereof for the purpose of preventing fog during manufacture of the photographic material, storaging, photographic processing or stabilizing the photographic properties of the material. Specific examples of the compounds which are preferably used for the purposes are described in the above-mentioned JP-A-62-215272, pages 39 to 72.

The emulsion for use in the present invention may be either a surface latent image type emulsion which forms a latent image essentially on the surfaces of the silver halide grains in the emulsion or an internal latent image type emulsion which forms a latent image essentially in the inside of the grains.

Where the present invention is applied to color photographic materials, the materials generally contain yellow coupler, magenta coupler and cyan coupler which form yellow, magenta and cyan dyes, respectively, after coupled with the oxidation product of an aromatic amine color-developing agent.

Cyan couplers, magenta couplers and yellow couplers which are preferably employed in the present invention are those of the following formulae (C-I), (C-II), (M-I), (M-II) and (Y).

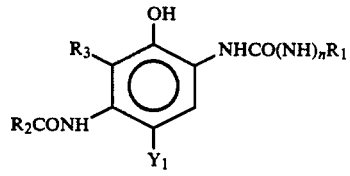

(C-I)

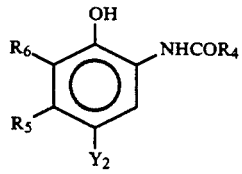

(C-II)

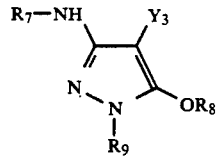

(M-I)

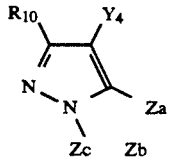

(M-II)

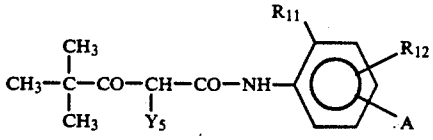

(Y)

In formulae (C-I) and $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group or an acylamino group, and $R_3$ may form, together with $R_2$, a nitrogen-containing 5-membered or 6-membered non-metallic atomic group; $Y_1$ and $Y_2$ each represents a hydrogen atom or a group capable of being split off from the formula by coupling reaction with the oxidation product of a developing agent; and n represents 0 or 1.

In formula (C-II), $R_5$ is preferably an aliphatic group, for example, methyl group, ethyl group, propyl group, butyl group, pentadecyl group, tert-butyl group, cyclohexyl group, cyclohexylmethyl group, phenylthiomethyl group, dodecyloxyphenylthiomethyl group, butanamidomethyl group or methoxymethyl group.

Preferred examples of cyan couplers of the above-mentioned formulae (C-I) and (C-II) are mentioned below.

Precisely, in formula (C-I), $R_1$ is preferably an aryl group or a heterocyclic group, more preferably an aryl group as substituted by one or more substituents selected from a halogen atom, an alkyl group, an alkoxy group, an aryloxy group, an acylamino group, an acyl group, a carbamoyl group, a sulfoamido group, a sulfamoyl group, a sulfonyl group, a sulfamido group, an oxycarbonyl group and a cyano group.

In formula (C-I), where $R_3$ and $R_2$ do not form a ring, $R_2$ is preferably a substituted or unsubstituted alkyl or aryl group, especially preferably a substituted aryloxy-substituted alkyl group. $R_3$ is preferably a hydrogen atom.

In formula (C-II), $R_4$ is preferably a substituted or unsubstituted alkyl or aryl group, most preferably a substituted aryloxy-substituted alkyl group.

In formula (C-II), $R_5$ is preferably an alkyl group having from 2 to 15 carbon atoms or a methyl group having substituent(s) with one or more carbon atoms. Preferred examples of the substituent(s) of the substituted methyl group are an arylthio group, an alkylthio group, an acylamino group, an aryloxy group and an alkyloxy group.

In formula (C-II), $R_5$ is more preferably an alkyl group having from 2 to 15 carbon atoms, more preferably an alkyl group having from 2 to 4 carbon atoms.

In formula (C-II), $R_6$ is preferably a hydrogen atom or a halogen atom, more preferably a chlorine atom or fluorine atom. In formulae (C-I) and (C-II), $Y_1$ and $Y_2$ each are preferably a hydrogen atom, a halogen atom, an alkoxy group, an aryloxy group, an acyloxy group or a sulfonamido group.

In formula (M-I), $R_7$ and $R_9$ each represent an aryl group; $R_8$ represents a hydrogen atom, an aliphatic or aromatic acyl group, or an aliphatic or aromatic sulfonyl group; and $Y_3$ represents a hydrogen atom or a group capable of being split off from the formula by coupling reaction with the oxidation product of a developing agent. The aryl group of $R_7$ or $R_9$ may be substituted and is preferably an optionally substituted phenyl group. Regarding possible substituents, those stated for $R_1$ are referred to. Where the group has two or more substituents, they may be same or different.

$R_8$ is preferably a hydrogen atom, or an aliphatic acyl or sulfonyl group, more preferably a hydrogen atom.

$Y_3$ is preferably a split-off group which may be split off from the formula via the sulfur, oxygen or nitrogen atom. For instance, sulfur atom-split off groups described in U.S. Pat. No. 4,351,897 and International Patent Application Laid-Open No. W088/04795 are especially preferred.

In formula (M-II), $R_{10}$ represents a hydrogen atom or a substituent which includes the same substituents disclosed in U.S. Pat. No. 4,540,654 disclosed below. $Y_4$ represents a hydrogen atom or a split-off group, and it is more preferably a halogen atom or an arylthio group. Za, Zb and Zc each represent a methine group, a substituted methine group, =N— or —NH—. One of Za—Zb bond and Zb—Zc bond is a double bond and the other is a single bond. Where Zb—Zc bond is a carbon-carbon double bond, it may be a part of an aromatic ring. The formula may form a dimer or a higher polymer at $R_{10}$ or $Y_4$. Where Za, Zb or Zc is a substituted methine group, the formula may also form a dimer or a higher polymer at the substituted methine group.

Among pyrazoloazole couplers of formula (M-II), imidazo[1,2-b]pyrazoles described in U.S. Pat. No. 4,500,630 are preferred as giving color dyes having small yellow side-absorption and high light-fastness. In particular, pyrazolo[1,5-b][1,2,4]triazoles described in U.S. Pat. No. 4,540,654 are especially preferred.

Additionally, pyrazolotriazole couplers in which a branched alkyl group is directly bonded to 2-, 3- or 6-position of the pyrazolotriazole ring, as described in JP-A-61-65245; pyrazoloazole couplers having a sulfonamido group in the molecule, as described in JP-A-61-65246; pyrazoloazole couplers having an alkoxyphenylsulfonamido ballast group, as described in JP-A-61-147254; and pyrazolotriazole couplers having an alkoxy group or aryloxy group at the 6-position, described in European Patent Laid-Open Nos. 226,849 and 294,785 are also preferably used in the present invention.

In formula (Y), $R_{11}$ represents a halogen atom, an alkoxy group, a trifluoromethyl group, or an aryl group; $R_{12}$ represents a hydrogen atom, a halogen atom, or an alkoxy group; and A represents —$NHCOR_{13}$—, —$NHSO_2$—$R_{13}$, —$SO_2NHR_{13}$, —$COOR_{13}$, or —$SO_2N(R_{14})$—$R_{13}$. $R_{13}$ and $R_{14}$ each represent an alkyl group, an aryl group or an aCyl group. $Y_5$ represents a split-off group. The groups of $R_{12}$, $R_{13}$ and $R_{14}$ each may further be substituted. As examples of substituents of the groups, those of $R_1$ may be referred to. The split-off group of $Y_5$ is preferably one which may split off from the formula via oxygen atom or nitrogen atom, and it is more preferably a nitrogen atom-split off group.

Specific examples of couplers of formulae (C-I), (C-II), (M-I), (M-II) and (Y) are mentioned below.

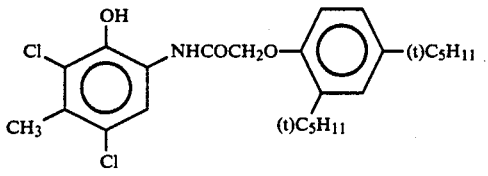

(C-1)

-continued
(C-2)
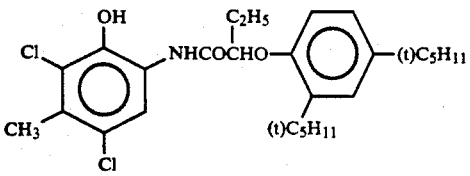
(C-3)
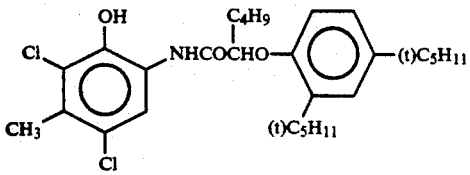
(C-4)
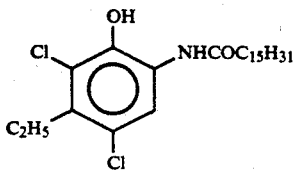
(C-5)
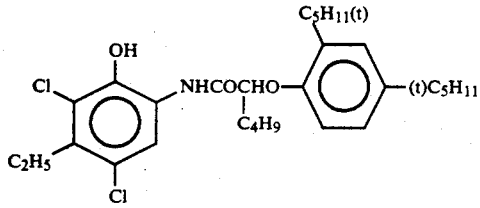
(C-6)
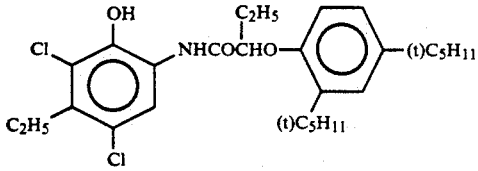
(C-7)
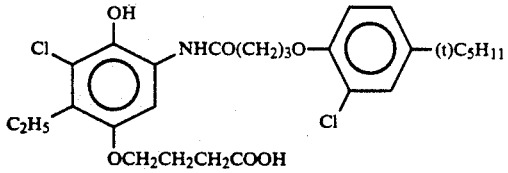
(C-8)
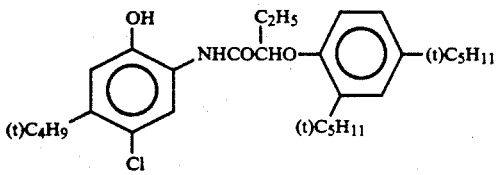
(C-9)
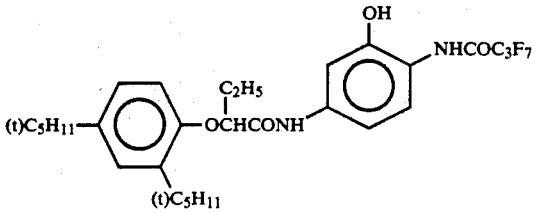

-continued
(C-10)
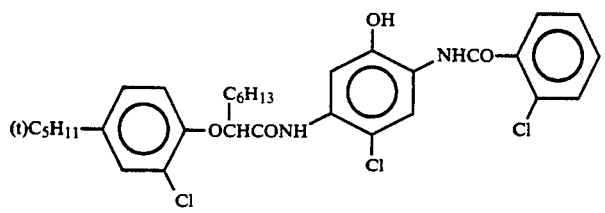
(C-11)
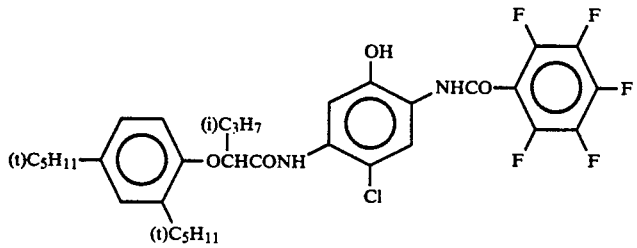
(C-12)
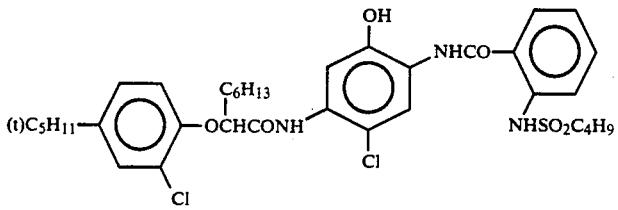
(C-13)
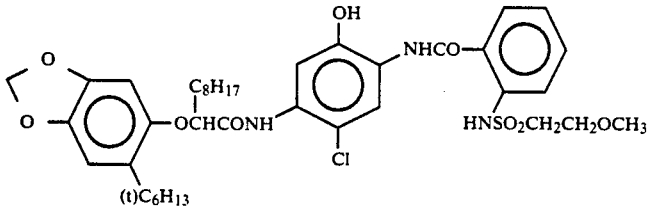
(C-14)
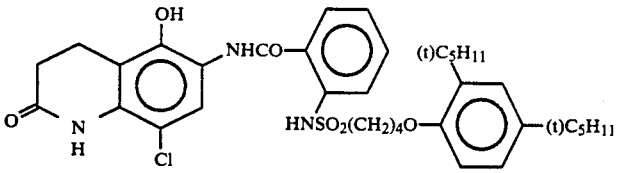
(C-15)
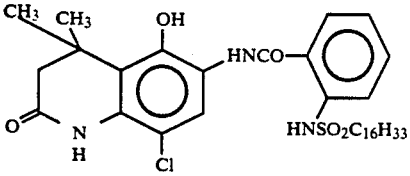
(C-16)
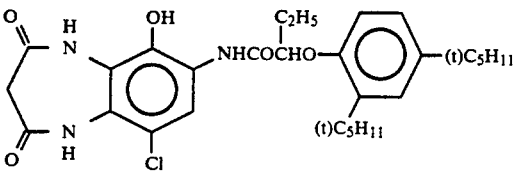

-continued
(C-17)
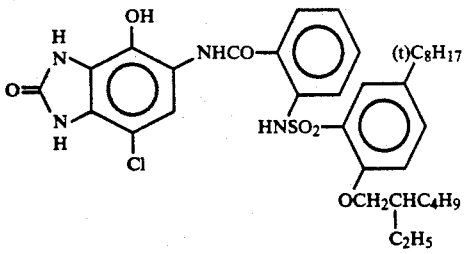
(C-18)
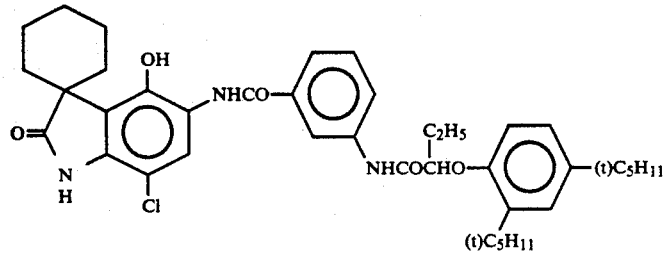
(C-19)
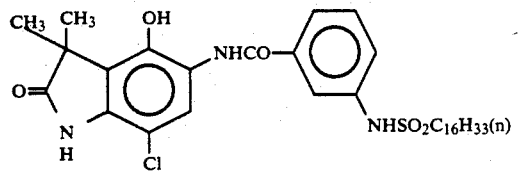
(C-20)
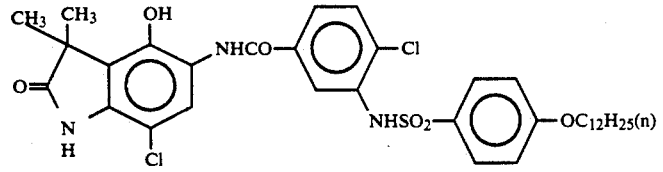
(C-21)
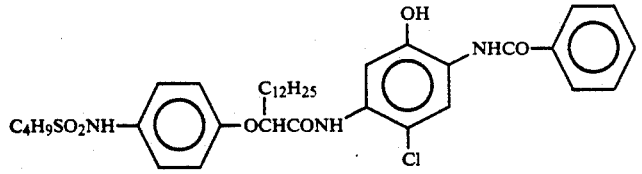
(C-22)
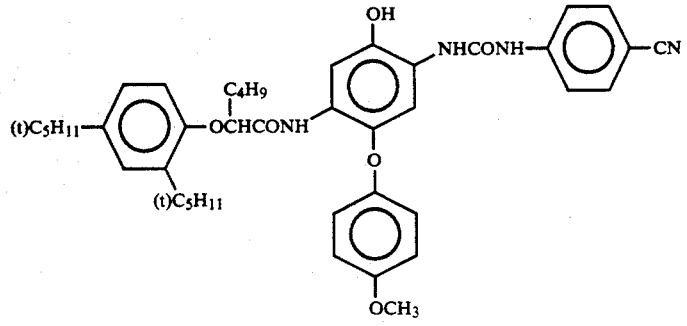

-continued
(M-1)
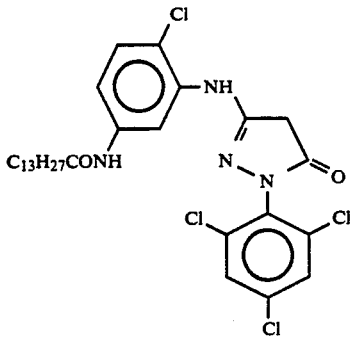
(M-2)
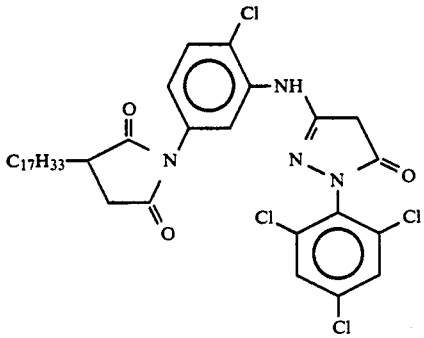
(M-3)
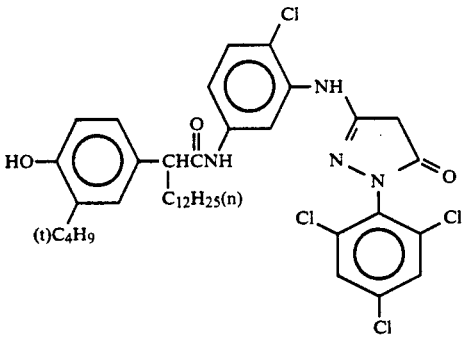
(M-4)
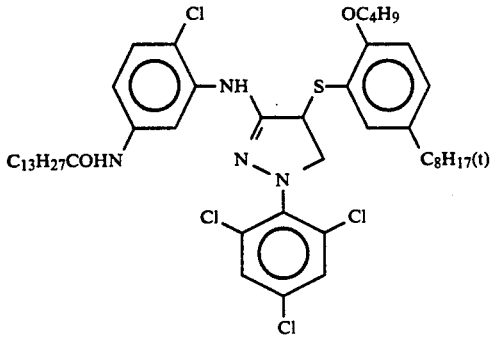

-continued
(M-5)
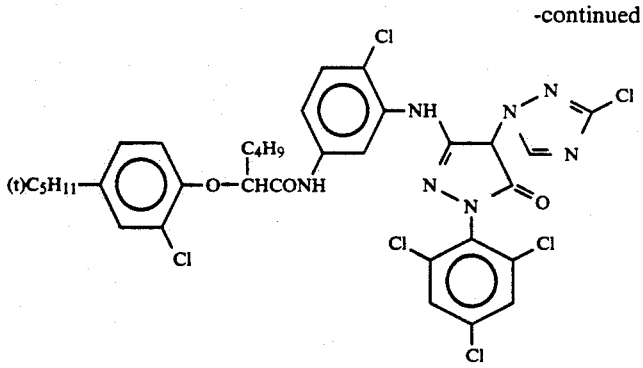
(M-6)
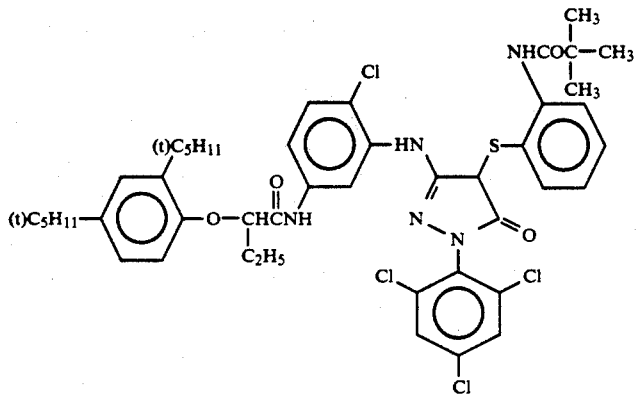
(M-7)
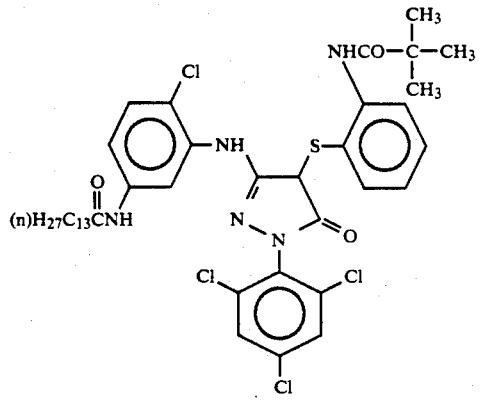
(M-8)
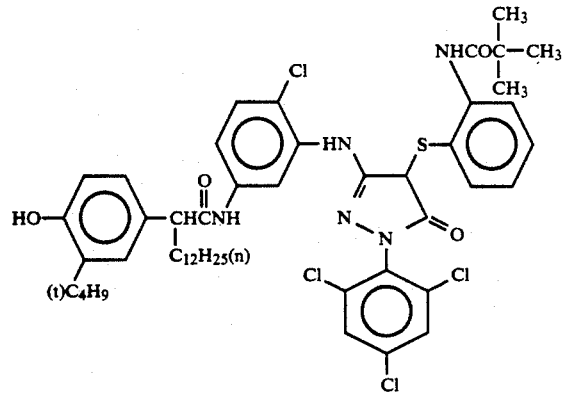

| Compound | $R_{10}$ | $R_{15}$ | $Y_4$ |
|---|---|---|---|
| | | 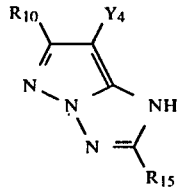 | |
| M-9 | $CH_3$— | 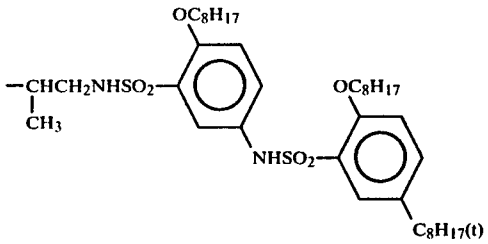 | Cl |
| M-10 | " | 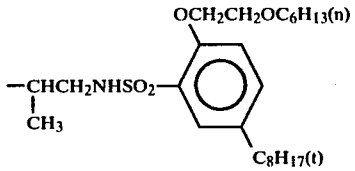 | " |
| M-11 | $(CH_3)_3C$— | 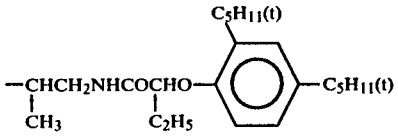 | 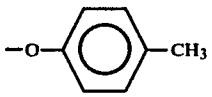 |
| M-12 | 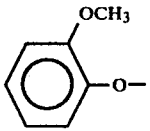 | 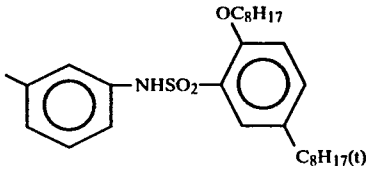 | 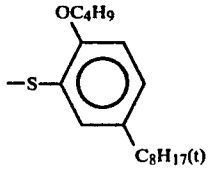 |

-continued
| | | | |
|---|---|---|---|
| M-13 | $CH_3$— | 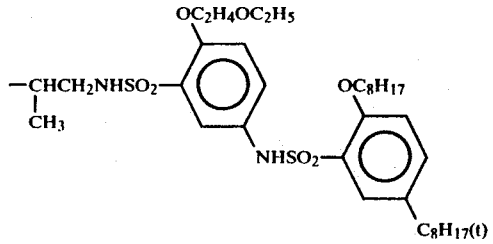 | Cl |
| M-14 | " | 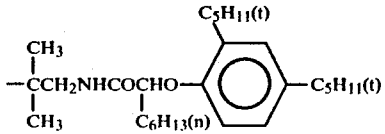 | " |
| M-15 | $CH_3$— | 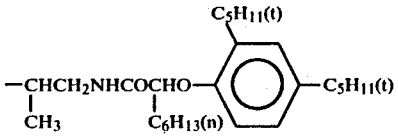 | Cl |
| M-16 | " | 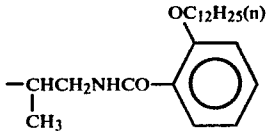 | " |
| M-17 | " | 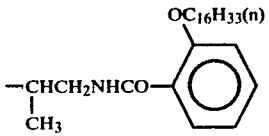 | " |

-continued
| | | | |
|---|---|---|---|
| M-18 | 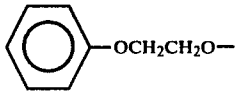 | 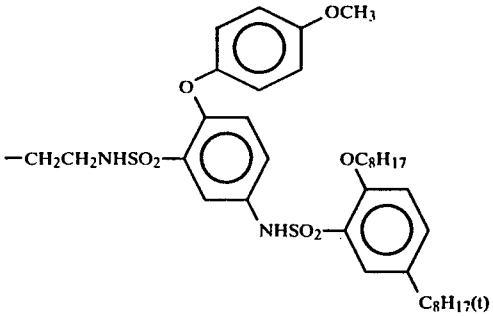 | 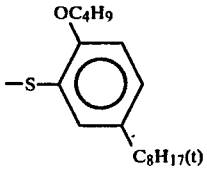 |
| M-19 | $CH_3CH_2O-$ | " | " |
| M-20 | 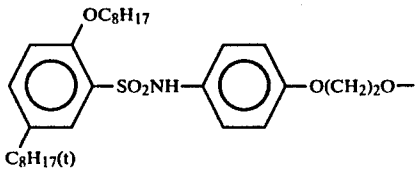 | 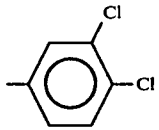 | 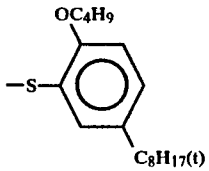 |
| M-21 | 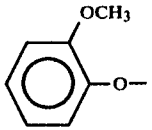 | 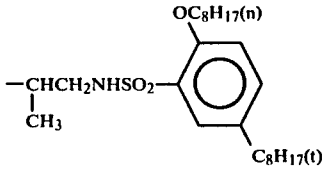 | Cl |
| M-22 | $CH_3-$ | 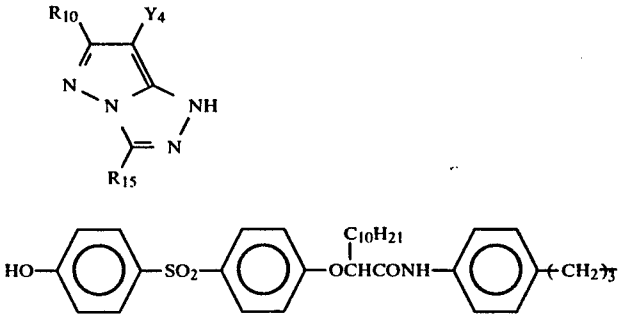 | Cl |

-continued

| | | | |
|---|---|---|---|
| M-23 | " | $(n)C_6H_{13}$ \ $CHCH_2SO_2\text{-}(CH_2)_2$ / $(n)C_8H_{17}$ | " |
| M-24 | $CH_3$ \ $CH-$ / $CH_3$ | $OC_4H_9$; $SO_2\text{-}(CH_2)_3$; $C_8H_{17}(t)$ | " |
| M-25 | $\text{-}(CH-CH_2)_{50}\text{-}(CH_2-C(CH_3))_{50}\text{-}$; $COOCH_2CH_2OCH_3$; $CONH-$ | $CH_3-CH-$; $CH_2NHSO_2CH_3$ | " |
| M-26 | $-O-$ | $OC_8H_{17}$; $\text{-}(CH_2)_2NHSO_2-$; $C_8H_{17}(t)$ | Cl |
| M-27 | $CH_3-$ | $CH_3$; $CH_3$; $CH_3$; $NHCOCHO-$; $(n)C_{10}H_{21}$; $-SO_2-$; $-OCH_2-$ | " |
| M-28 | $(CH_3)_3C-$ | $CH_3$; $CH_3$; $CH_3$; $C_5H_{11}(t)$; $NHCOCHO-$; $C_4H_9(n)$; $C_5H_{11}(t)$ | " |

-continued
| | | | |
|---|---|---|---|
| M-29 | 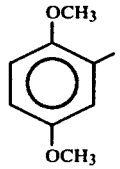 | 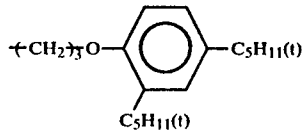 | Cl |
| M-30 | $CH_3$— | $(n)C_{18}H_{37}$ \| —CH—$NCOCH_2CH_2COOH$ \| $C_2H_5$ | " |
(Y-1)
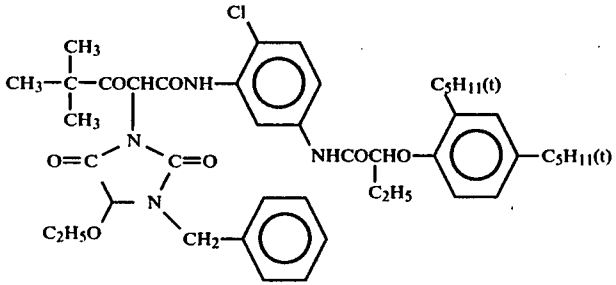
(Y-2)
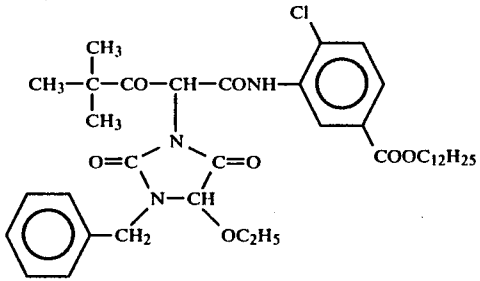
(Y-3)
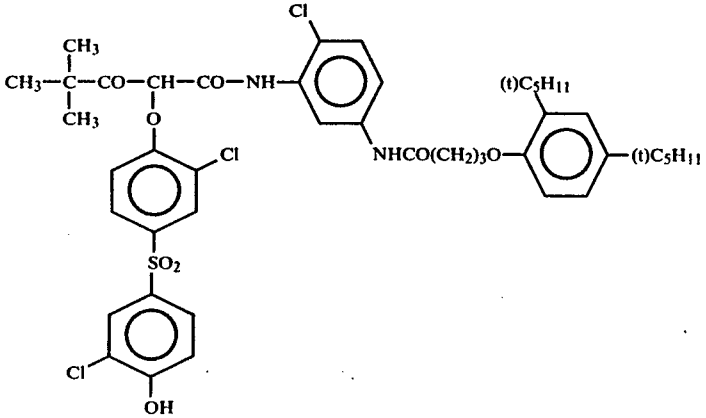
(Y-4)
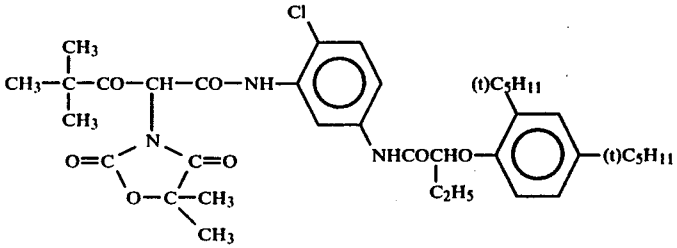

-continued
(Y-5)
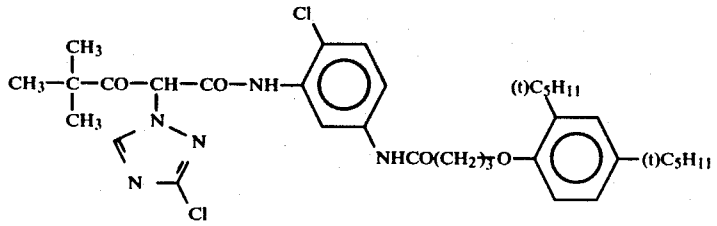
(Y-6)
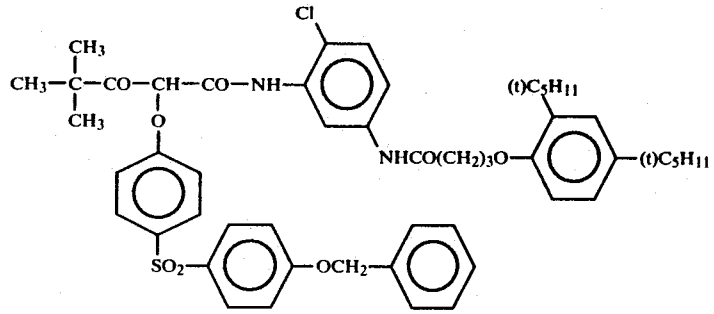
(Y-7)
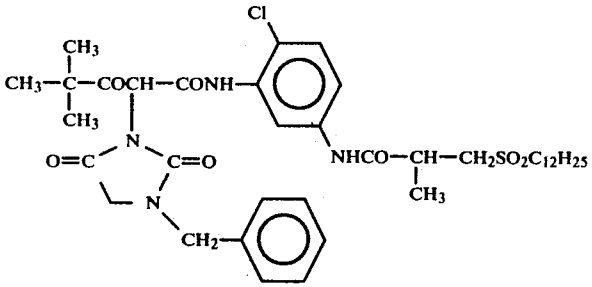
(Y-8)
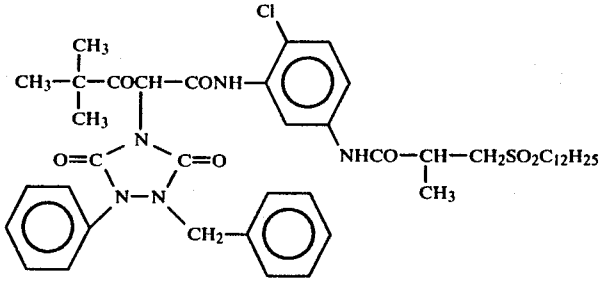
(Y-9)
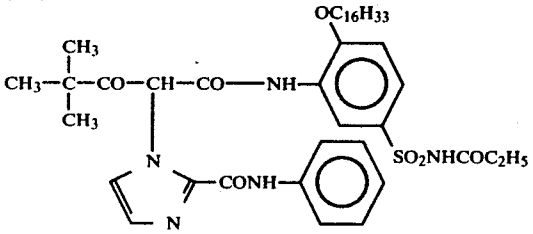

The amount of the coupler of the above-mentioned formulae (C-I) to (Y) in the silver halide emulsion constituting a light-sensitive layer is generally from about 0.1 to about 1.0 mol, preferably from 0.1 to 0.5 mol, per mol of the silver halide in the emulsion.

In order to add the above-mentioned coupler into the light-sensitive layer, various known techniques may be employed. In general, it may be added to the layer by an oil-in-water dispersion method, which is known as an oil-protecting method. In accordance with this method, the coupler is dissolved in a solvent and then dispersed in a surfactant-containing aqueous gelatin solution by emulsification. Alternatively, water or an aqueous gelatin solution may be added to a surfactant-containing coupler solution to give an oil-in-water dispersion after phase conversion.

Where an alkali-soluble coupler is used, it may be added to the photographic emulsion by the Fisher dispersion method. The low-boiling point organic solvent may be removed from the coupler dispersion by distillation, noodle washing or ultrafiltration, and thereafter the resulting coupler dispersion may be added to the photographic emulsion.

As a dispersing medium for the coupler, a high boiling point organic solvent and/or a water-insoluble polymer compound having a dielectric constant of from about 2 to about 20 (at 25° C.) and a refractive index of from about 1.5 to about 1.7 (at 25° C.) are/is preferably used.

Preferred high boiling point organic solvents are those of the following general formulae (A) to (E).

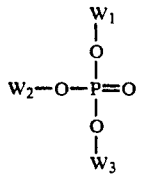
(A)

$W_1-COO-W_2$ (B)

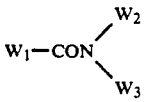
(C)

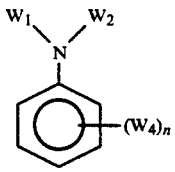
(D)

$W_1-O-W_2$ (E)

In these formulae, $W_1$, $W_2$ and $W_3$ each represent a substituted or unsubstituted alkyl, cycloalkyl, alkenyl, aryl or heterocyclic group; $W_4$ represents $W_1$, $OW_1$ or $SW_1$; and n represents from 1 to 5. Where n is 2 or more, plural $W_4$'s may be same or different. In formula (E), $W_1$ and $W_2$ may form a condensed ring.

In addition to the compounds of formulae (A) to (E), any other water-immiscible compounds having a melting point of 100° C. or lower and a boiling point of 140° C. or higher may be used as high boiling point organic solvents for couplers, provided that they are good solvents for couplers. The high boiling point organic solvents usable in the present invention have a melting point of preferably 80° C. or lower and a boiling point of preferably 160° C. or higher, more preferably 170° C. or higher.

The details of such high boiling point organic solvents are described in JP-A-62-215272, from page 137, right lower column to page 144, right upper column.

Additionally, it is also possible that the coupler of the present invention is infiltrated into a loadable latex polymer (for example, U.S. Pat. No. 4,203,716) in the presence or absence of the above-mentioned high boiling point organic solvent or is dissolved in a water-insoluble and organic-soluble polymer, before being dispersed in an aqueous hydrophilic colloid solution by emulsification.

Preferably, homopolymers or copolymers as described in International Patent Application Laid-Open No. W088/00723, pages 12 to 30 are used. In particular, use of acrylamide polymers is especially preferred in view of the function of stabilizing the image to be formed.

The photographic material of the present invention may contain hydroquinone derivatives, aminophenol derivatives, gallic acid derivatives and ascorbic acid derivatives, as a color-fogging inhibitor.

The photographic material of the present invention may contain various anti-fading agents. For instance, examples of anti-fading agents to cyan, magenta and/or yellow images, which are usable in the present invention are hindered phenols such as hydroquinones, 6-hydroxychromans, 5-hydroxycoumarans, spirochromans, p-alkoxyphenols and bisphenols; gallic acid derivatives; methylenedioxybenzenes; aminophenols; hindered amines; as well as ether or ester derivatives thereof prepared by silylating or alkylating the phenolic hydroxyl group in the compounds. In addition, metal complexes such as (bissalicylaldoximato)-nickel complexes and (bis-N,N-dialkyldithiocarbamato)nickel complexes may also be employed.

Specific examples of organic anti-fading agents usable in the present invention are mentioned in the following patent publications.

Precisely, hydroquinones are described in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; 6-hydroxychromans, 5-hydroxycoumarans and spirochromans are described in U.S. Pat. Nos. 3,432,300, 3,573,050, 3,574,627, 3,698,909 and 3,764,337, and JP-A-52-152225; spiroindanes are described in U.S. Pat. No. 4,360,589; p-alkoxyphenols are described in U.S. Pat. No. 2,735,765, British Patent 2,066,975, JP-A-59-10539 and JP-B-57-19765; hindered phenols are described in U.S. Pat. No. 3,700,455, JP-A-52-2224, U.S. Pat. No. 4,228,235 and JP-B-52-6623; gallic acid derivatives, methylenedioxybenzenes and aminophenols are described in U.S. Pat. Nos. 3,457,079 and 4,332,886, and JP-A-56-21144; hindered amines are described in U.S. Pat. Nos. 3,336,135 and 4,268,593, British Patents 1,326,889, 1,354,313 and 1,410,846, JP-B-51-1420 and JP-A-58-114036, JP-A-59-53846 and JP-A-59-78344; and metal complexes are described in U.S. Pat. Nos. 4,050,938 and 4,241,155 and British Patent 2,027,731(A).

In general, these compounds are added to light-sensitive layers in an amount of generally from about 5 to about 100% by weight to the corresponding color couplers by co-emulsifying with the couplers, whereby the intended object is attained. In order to prevent deterioration of a cyan color image by heat and especially by light, it is more effective to incorporate an ultraviolet absorbent to the cyan coloring layer and to both the adjacent layers.

The ultraviolet absorbent include aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070, 3,677,672 and 4,371,307). Additionally, ultraviolet-absorbing couplers (for example, cyan dye-forming alpha-naphthol couplers) as well as ultraviolet-absorbing polymers may also be used for the purpose. Such ultraviolet absorbents may be mordanted in a particular layer.

Above all, the above-mentioned aryl group-substituted benzotriazole compounds are especially preferred.

In accordance with the present invention, the following compounds are preferably employed together with the above-mentioned couplers. In particular, such compounds are more preferably employed in combination with pyrazoloazole couplers.

Specifically, compounds (F), described below, which may chemically bond with the aromatic amine developing agent as remaining after color development to give a chemically inactive and substantially colorless compound and/or compounds (G), described below, which may chemically bond with the oxidation product of the aromatic amine developing agent remaining after color development to give a chemically inactive and substantially colorless compound are preferably employed simultaneously or singly. Employment of such compounds is preferred, for example, for preventing stains caused by formation of colored dyes by reaction between the developing agent or the oxidation product thereof remaining in the film and the coupler which also remains during storage of the processed material. Also, the compounds are preferably employed for preventing other harmful side-reactions.

Compounds (F) are preferably compounds which react with p-anisidine with a secondary reaction speed constant $k^2$ (in trioctyl phosphate at 80° C.) of from 1.0 liter/mol·sec to $1\times10^{-5}$ liter/mol·sec. The secondary reaction speed constant can be measured by the method described in JP-A-63-158545.

If the value $k^2$ is larger than the stated range, the compounds themselves would be unstable and would often react with gelatin and water to decompose. On the other hand, if it is smaller than the stated range, the reaction speed of the compound with the remaining amine developing agent would be low and, as a result, the object of the present invention to prevent the harmful side effects of the remaining aromatic amine developing could not be attained.

More preferred examples of such compounds (F) are those represented by the following formula (FI) or (FII).

$$R_1-(A)_n-X \qquad \text{(FI)}$$

-continued $$R_2-\underset{\underset{B}{|}}{C}=Y \qquad \text{(FII)}$$

In these formulae, $R_1$ and $R_2$ each represents an aliphatic group, an aromatic group or a heterocyclic group; n represents 1 or 0; A represents a group capable of reacting with an aromatic amine developing agent to form a chemical bond; X represents a group capable of reacting with an aromatic amine developing agent to be split off from the formula; B represents a hydrogen atom, an aliphatic group, an aromatic group, a heterocyclic group, an acyl group or a sulfonyl group; and Y represents a group accelerating addition of an aromatic amine developing agent to the compound of formula (FII). $R_1$ and X; and Y and $R_2$ or B may be bonded to each other to form a cyclic structure.

Typical methods of reacting the compounds and the remaining aromatic amine developing agent by chemical bond are substitution reaction and addition reaction.

Specific examples of the compounds of formulae (FI) and (FII) are described in JP-A-63-158545 and JP-A-62-283338 and European Patent Laid-Open Application Nos. 298,321 and 277,589 and are preferably employed in the present invention.

On the other hand, compounds (G), which chemically bond with the oxidation product of the aromatic amine developing agent as remaining after color development to give a chemically inert and substantially colorless compound, more preferrably include those represented by the following formula (GI):

$$R-Z \qquad \text{(GI)}$$

where R represents an aliphatic group, an aromatic group or a heterocyclic group; and Z represents a nucleophilic group or a group capable of releasing a nucleophilic group after decomposition in the photographic material. In the compounds of the formula (GI), Z is preferably a group having a nucleophilic $nCH_3I$ value (R. G. Pearson, et al., *J. Am. Chem. Soc.*, 90, 319 (1968)) which is 5 or more or a group to be derived therefrom.

Specific examples of the compounds of the formula (GI) are described in EP-A-255722, JP-A-62-143048, JP-A-62-229145, JP-A-1-230039 and JP-A-1-57259 and EP-A-298321 and EP-A-277589 and are preferably used in the present invention.

The details of the combination of the above-mentioned compounds (G) and compounds (F) are described in European Patent Laid-Open Application No. 277,589.

The photographic materials of the present invention may contain water-soluble dyes or dyes which may be converted into water-soluble dyes by photographic processing, in the hydrophilic colloid layers as a filter dye or for the purpose of anti-irradiation or anti-halation or for other purposes. Such dyes include, for example, oxonole dyes, hemioxonole dyes, styryl dyes, merocyanine dyes, cyanine dyes and azo dyes. Oxonole dyes, hemioxonole dyes and merocyanine dyes are preferred.

As the binder or protective colloid usable in the emulsion layers of constituting the photographic material of the present invention, gelatin is advantageous. However, any other hydrophilic colloid may also be used singly or in combination with gelatin.

Gelatin usable in the present invention may be either a lime-processed gelatin or an acid-processed gelatin. The details of preparation of various gelatins are described in, for example, Arther Vais, *The Macromolecular Chemistry of Gelatin* (published by Academic Press, 1964).

As the support for forming the photographic material of the present invention, in general, a transparent support which is generally used in conventional photographic materials, such as cellulose nitrate film or polyethylene terephthalate film, as well as a reflective support can be used. The reflective support is more preferred in view of the object of the present invention.

The reflective support which can be employed in the present invention is preferably one which improves the reflectivity so that the color image as formed on the silver halide emulsion layer is sharp. Such reflective support includes a support prepared by coating a hydrophobic resin which contains a dispersion of a light-reflecting substance such as titanium oxide, zinc oxide, calcium carbonate or calcium sulfate on a support base, or a support made of a hydrophobic resin which contains a dispersion of the light-reflecting substance.

For instance, a baryta paper, a polyethylene-coated paper, a synthetic polypropylene paper, as well as a transparent support (e.g., glass sheet, polyester films such as polyethylene terephthalate, cellulose triacetate or cellulose nitrate, or polyamide films, polycarbonate films, polystyrene films or vinyl chloride resins) coated with a reflective layer or containing a reflecting substance can be used.

In addition, a support having a metal surface with mirror reflectivity or secondary diffusion-reflectivity may also be used as a reflective support. In a reflective support of this type, the metal surface is desired to have a spectral reflectivity of 0.5 or more in the visible wavelength range. Additionally, the metal surface is also preferably coarsened or is made diffusive and reflective by applying a metal powder thereto. As the metal usable for this purpose, aluminium, tin, silver, magnesium and alloys thereof can be used.

The surface may be derived from a metal plate, metal foil or thin metal layer to be obtained by rolling, vapor deposition or plating. The metal surface is preferably obtained by depositing a metal on the surface of a base by vapor deposition. The metal surface is preferably overcoated with a water-proofing resin layer, especially a thermoplastic resin layer.

In the support of the present invention, which has the above-mentioned metal surface, the other surface may be coated with an antistatic layer. The details of the support of the kind are described in, for example, JP-A-61-210346, JP-A-63-24247, JP-A-63-24251 and JP-A-3-24255.

The above-mentioned supports may suitably be selected in accordance with the use and objects of the present invention.

As the above-mentioned light-reflecting substance, it is preferred that a white pigment is fully kneaded in the presence of a surfactant, or pigment grains surface-treated with a 2- to 4-valent alcohol are also preferably employed.

Where fine grains of a white pigment are incorporated into the support, the exclusive area ratio (%) of the grains per unit area is obtained most typically by dividing the observed area into the adjacent unit area of 6 μm×6 μm and measuring exclusive area ratio (%) (Ri) of the fine grains as projected to the unit area. The fluctuation coefficient of the exclusive area ratio (%) can be obtained as the ratio s/R of the standard deviation (s) of Ri to the mean value (R) of Ri. The number (n) of the unit areas for measurement is preferably 6 or more. Accordingly, the fluctuation coefficient s/R can be obtained from the following formula:

$$\sqrt{\frac{\sum_{i=1}^{n}(Ri-\overline{R})^2}{n-1}} \Big/ \frac{\sum_{i=1}^{n} Ri}{n}$$

In accordance with the present invention, the fluctuation coefficient of the exclusive area ratio (%) of the fine pigment grains is preferably about 0.20 or less, especially preferably 0.15 or less. If it is 0.08 or less, it can be said that the dispersibility of the grains is substantially "uniform".

Where the present invention is applied to a color photographic material, the material is preferably processed by color development, bleach-fixation, and rinsing in water (or stabilization). Bleaching and fixation may be effected separately in different baths, in place of being effected simultaneously in one bath.

The color developer for use in the present invention contain a known aromatic primary amine color developing agent.

Preferred examples of the agent are p-phenylenediamine derivatives, and specific examples thereof are mentioned below. However, these are not limitative.

D-1 N,N-diethyl-p-phenylenediamine
D-2 2-amino-5-diehtylaminotoluene
D-3 2-amino-5-(N-ethyl-N-laurylamino)toluene
D-4 4-[N-ethyl-N-(β-hydroxyethyl)amino]aniline
D-5 2-methyl-4-[N-ethyl-N-(β-hydroxyethyl-)amino]aniline
D-6 4-amino-3-methyl-N-ethyl-N-[β-(methanesulfonamido)ethyl]aniline
D-7 N-(2-amino-5-diethylaminophenylethyl)methanesulfonamide
D-8 N,N-dimethyl-p-phenylenediamine
D-9 4-amino-3-methyl-N-ethyl-N-methoxyethylaniline
D-10 4-amino-3-methyl-N-ethyl-N-β-ethoxyethylaniline
D-11 4-amino 3-methyl-N-ethyl-N-β-butoxyethylaniline Of the above-mentioned p-phenylenediamine derivatives, especially preferred is 4-amino-3-methyl-N-ethyl-N-[β-(methanesulfonamido)ethyl]aniline (D-6).

The p-phenylenediamine derivatives may be in the form of salts such as sulfates, hydrochlorides, sulfites or p-toluenesulfonates. The amount of the aromatic primary amine developing agent to be used is preferably from about 0.1 g to about 20 g, more preferably from about 0.5 g to about 10 g, per liter of the developer.

In the practice of the present invention, a developer which does not substantially contain benzyl alcohol is preferably employed. The developer which does not substantially contain benzyl alcohol means a benzyl alcohol concentration of about 2 ml/liter or less, more preferably 0.5 ml/liter or less. Most preferably, the developer contains no benzyl alcohol.

The developer for use in the present invention preferably does not substantially contain a sulfite ion. Sulfite ions function as a preservative for the developing agent but additionally have a silver halide-solubilizing function and the function of reacting with the oxidation product of the developing agent to lower the dye-forming efficiency. Such functions are presumed to be a factor in the increase of the fluctuation of the photographic characteristics of the material in continuous processing thereof. The developer which does not substantially contain a sulfite ion means a sulfite ion concentration of preferably about $3.0\times10^{-3}$ mol/liter or less, more preferably containing no sulfite ion. In the present invention, however, an extremely small amount of sulfite ion may be incorporated into the concentrated developing agent stock as an antioxidant for the processing liquid kit, before the stock is prepared for the ready-to-use solution.

As mentioned above, it is preferred that the developer for use in the present invention does not substantially contain sulfite ions, and more preferably, the developer does not also substantially contain hydroxylamine. This is because hydroxylamine is considered to function as a preservative for the developer and additionally have silver-developing activity by itself whereby the fluctuation of the concentration of such hydroxylamine in the developer would greatly influence the photographic characteristics of the material to be processed. The developer which does not substantially contain hydroxylamine means a hydroxylamine concentration of about $5.0\times10^{-3}$ mol/liter or less, more preferably containing no hydroxylamine.

The developer for use in the present invention is preferred to contain an organic preservative in place of the above-mentioned hydroxylamine and sulfite ions.

The organic preservative to be used for this purpose includes any and every organic compound which may retard the deteriorating speed of aromatic primary amine color developing agents when added to the processing solution for color photographic materials. Specifically, it includes organic compounds which function to prevent oxidation of color developing agents by air. Hydroxylamine derivatives (except hydroxylamine—the same shall apply hereunder), hydroxamic acids, hydrazines, hydrazides, phenol, α-hydroxyketones, α-aminoketones, saccharides, monoamines, diamines, polyamides, quaternary ammonium salts, nitroxy radicals, alcohols, oximes, diamine compounds and condensed polycyclic amines are especially effective organic preservatives. These are illustrated in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020 and JP-B-48-30496.

As other preservatives which may be incorporated into the developer for use in the present invention, various metals described in JP-A-57-44148 and JP-A-57-53749; salicylic acids described in JP-A-59-180588; alkanolamines described in JP-A-54-3532; polyethyleneimines described in JP-A-56-94349; and aromatic polyhydroxy compounds described in U.S. Pat. No. 3,746,544 are useful. In particular, addition of alkanolamines such as triethanolamine, dialkylhydroxylamines such as diethylhydroxylamine, or hydrazine derivatives or aromatic polyhydroxy compounds are preferred.

Among the above-mentioned organic preservatives, hydroxylamine derivatives and hydrazine derivatives (hydrazines or hydrazides) are especially preferred, and the details thereof are described in Japanese Patent Application Nos. 62-255270, 63-9713, 63 9714 and 63-11300.

Combined use of both the above-mentioned hydroxylamine derivatives or hydrazine derivatives and the amine compound is more preferred for the purpose of improving the stability of the color developer and especially for improving the stability of the processing solution in continuous processing.

As the amine compounds, cyclic amines described in JP-A-63-239447, amines described in JP-A-63-128340 and amines described in Japanese Patent Application Nos. 63-9713 and 63-11300 are useful.

The color developer for use in the present invention preferably contains a chloride ion in an amount of from about $3.5\times10^{-2}$ to about $1.5\times10^{-1}$ mol/liter. Preferably, the amount of the ion is from $4\times10^{-2}$ to $1\times10^{-1}$ mol/liter. If the chloride ion concentration is more than $1.5\times10^{-1}$ mol/liter, the excess ion concentration would cause the drawback of retarding the developability of the developer. Such is unfavorable for attaining the object of the present invention which is to obtain a high maximum color density by rapid development procedure. If the chloride ion concentration is less than $3.5\times10^{-2}$ mol/liter, the developer would be unfavorable for preventing fog.

The color developer for use in the present invention preferably contains a bromide ion in an amount of from about $3.0\times10^{-5}$ mol/liter to about $1.0\times10^{-3}$ mol/liter. More preferably, the ion concentration is from $5.0\times10^{-5}$ to $5.0\times10^{-4}$ mol/liter. If the bromide ion concentration is more than $1\times10^{-3}$ mol/liter, the developability of the developer would be retarded and the maximum density of the color dye formed in the material processed as well as the sensitivity of the material would thereby be lowered. If, however, the bromide ion concentration is less than $3.0\times10^{-5}$ mol/liter, the developer could not sufficiently prevent fog.

The chloride ion and bromide ion may be directly added to the developer, or alternatively, they may be dissolved out from the photographic material containing the same during development procedure.

Where the ions are directly added to the color developer, the chloride ion-donating substance may be sodium chloride, potassium chloride, ammonium chloride, lithium chloride, nickel chloride, magnesium chloride, manganese chloride, calcium chloride and cadmium chloride. Among them, sodium chloride and potassium chloride are preferred.

The ions may be derived from the brightening agent as added to the developer.

As the bromide ion-donating substance, sodium bromide, potassium bromide, ammonium bromide, lithium bromide, calcium bromide, magnesium bromide, manganese bromide, nickel bromide, cadmium bromide, cerium bromide and thallium bromide are useful. Potassium bromide and sodium bromide are preferred.

The ions released from the photographic material into the developer during development procedure may be released from the emulsions of the material or may also be released from any component other than the emulsions.

The color developer for use in the present invention preferably has a pH value of from about 9 to about 12, more preferably from 9 to 11.0. The color developer can contain various developer components of known compounds, in addition to the above-mentioned components.

In order to maintain the above-mentioned pH value range, various buffers are peeferably added to the developer. Buffers usable for this purpose are, for example, carbonates, phosphates, borates, tetraborates, hydroxybenzoates, glycine salts, N,N-dimethylglycine salts, leucine salts, norleucine salts, guanine salts, 3,4-dihydroxy-phenylalanine salts, alanine salts, aminobutyrates, 2-amino-2-methyl-1,3-propanediol salts, valine salts, proline salts, trihydroxyaminomethane salts and lysine salts. In particular, carbonates, phosphates, tetraborates and hydroxybenzoates are preferred, as having a high solubility and an excellent buffering capacity in the pH range of 9.0 or higher. In addition, these buffers have further advantages such as an absence of bad influences (e.g., fog) on the photographic processing capacity of the developer when added to the developer and a low price.

As specific examples of these buffers, there are mentioned sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, these compounds are not limitative.

The amount of the buffer to be added to the color developer is preferably 0.1 mol/liter or more, preferably from 0.1 mol/liter to 0.4 mol/liter.

In addition, the color developer may further contain various chelating agents as an agent for preventing precipitation of calcium or magnesium or for the purpose of improving the stability of the color developer.

Examples of usable chelating agents include nitrilotriacetic acid, diethylenetriamine-pentaacetic acid, ethylenediamine-tetraacetic acid, N,N,N-trimethylene-phosphonic acid, ethylenediamine-N,N,N',N'-tetramethylenephosphonic acid, trans-cyclohexanediaminetetraacetic acid, 1,2-diaminopropane-tetraacetic acid, glycolether-diamine-tetraacetic acid, ethylenediamineorthohydroxyphenylacetic acid, 2-phosphono-butane-1,2,4-tricarboxylic acid, 1-hydroxyethylidene-1,1-diphosphonic acid, N,N'-bis(2-hydroxybenzyl)ethylenediamine-N,N'-diacetic acid.

These chelating agents can be used as a mixture of two or more, if desired.

The amount of the chelating agent to be added to the color developer may be such that is sufficient for sequestering the metal ions in the color developer. For instance, the amount is approximately from 0.1 g/liter to 10 g/liter.

The color developer for use in the present invention may contain any development accelerator, if desired.

Examples of usable development accelerators are thioether compounds described in JP-B-37-16088, 37-5987, 38-7826, 44-12380, 45-9019 and U.S. Pat. No. 3,813,417; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796, 3,253,919, JP B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; as well as other 1-phenyl-3-pyrazolidones and imidazoles.

The color developer for use in the present invention can contain any antifoggant, if desired. For instance, alkali metal halides such as sodium chloride, potassium bromide or potassium iodide as well as organic antifoggants can be used. As examples of usable organic antifoggants, nitrogen-containing heterocyclic compounds are typical, which include benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolidine and adenine.

The color developer for use in the present invention preferably contains a brightening agent. As the agent, 4,4'-diamino-2,2'-disulfostilbene compounds are preferred. The amount of the agent to be added to the color developer is up to 5 g/liter, preferably from 0.1 g/liter to 4 g/liter.

If desired, the color developer for use in the present invention may further contain various surfactants such as alkylsulfonic acids, arylsulfonic acids, aliphatic carboxylic acids and aromatic carboxylic acids.

The processing temperature with the color developer in accordance with the present invention is from about 20° to about 50° C., preferably from 30° to 40° C. The processing time is from about 20 seconds to about 5 minutes, preferably from 30 seconds to 2 minutes.

The amount of the replenisher added to the process with the color developer is preferably small. For instance, it is suitably from about 20 to about 600 ml, preferably from 50 to 300 ml, per $m^2$ of the photographic material being processed. More preferably, the amount of the replenisher is from 60 ml to 200 ml, most preferably from 60 to 150 ml, per $m^2$ of the material.

Next, the desilvering step to be applied to the present invention will be explained. As the desilvering step, any step comprising bleaching and fixation; fixation and bleach-fixation; bleaching and bleach-fixation; and bleach-fixation can be employed.

Now, the bleaching solution, bleach-fixing solution and fixing solution which can be employed in the present invention are explained below.

Any and every bleaching agent can be used in the bleaching solution or bleach-fixing solution. Especially preferred as the bleaching agent are organic complexes of iron(III) (for example, iron(III) complexes with aminopolycarboxylic acids such as ethylenediaminetetraacetic acid or diethylenetriamine-pentaacetic acid, or with aminopolyphosphonic acids, phosphonocarboxylic acids or organic phosphonic acids); or organic acids such as citric acid, tartaric acid or malic acid; persulfates; or hydrogen peroxide.

Among them, organic complexes of iron(III) are most preferred, as being suitable for rapid processing and being free from environmental pollution. As examples of aminopolycarboxylic acids, aminopolyphosphonic acids, organic phosphonic acids and salts thereof which are useful for forming organic complexes of iron(III), ethylenediamine-tetraacetic acid, diethylenetriamine-pentaacetic acid, 1,3-diaminopropanetetraacetic acid, propylenediamine-tetraacetic acid, nitrilotriacetic acid, cyclohexanediamine-tetraacetic acid, methyliminodiacetic acid, iminodiacetic acid, and glycol ether diamine-tetraacetic acid. These compounds may be in the form of sodium, potassium, lithium or ammonium salts thereof. Among them, iron(III) complexes of ethylenediamine-tetraacetic acid, diethylenetriamine-pentaacetic acid, cyclohexanediamine-tetraacetic acid, 1,3-diaminopropane-tetraacetic acid and methyliminodiacetic acid are preferred, as having a high bleaching capacity.

The ferric complex may directly be added to the solution as the complex itself; or alternatively, a ferric salt such as ferric sulfate, ferric chloride, ferric nitrat, ammonium ferric sulfate or ferric phosphate may be added to the solution together with a chelating agent such as an aminopolycarboxylic acid, aminopolyphosphonic acid or phosphonocarboxylic acid and the ferric complex may be formed in the solution. The amount of the chelating agent may be more than the necessary amount for forming the intended ferric complex. Among ferric complexes, aminopolycarboxylato/ferric complexes are preferred, and the amount thereof to be added to the solution is from 0.01 to 1.0 mol/liter, more preferably from 0.05 to 0.50 mol/liter.

The bleaching solution, the bleach-fixing solution and/or the previous bath thereof may contain compounds as a bleaching accelerator. For instance, mercapto group-containing or disulfido bond-containing compounds described in U.S. Pat. No. 3,893,858, German Patent 1,290,812, JP-A-53-95630 and *Research Disclosure,* Item No. 17129 (July, 1978); thiourea compounds described in JP-B-45-8506, JP-A-52-20832, JP-A-53-32735 and U.S. Pat. No. 3,706,561; as well as halides such as iodides or bromides are preferred as the bleaching accelerator, as having an excellent bleaching-accelerating capacity.

In addition, the bleaching solution or bleach-fixing solution which may be employed in the present invention may further contain a re-halogenating agent such as bromides (for example, potassium bromide, sodium bromide, ammonium bromide), chlorides (for example, potassium chloride, sodium chloride, ammonium chloride) or iodides (for example, ammonium iodide). If desired, the solution may further contain one or more inorganic acid or organic acid or alkali metal or ammonium salts thereof which have a pH-buffering capacity, such as borax, sodium metaborate, acetic acid, sodium acetate, sodium carbonate, potassium carbonate, phosphorus acid, phosphoric acid, sodium phosphate, citric acid, sodium citrate or tartaric acid, as well as an antiseptic such as ammonium nitrate or guanidine.

A known fixing agent can be employed in the bleach-fixing solution or fixing solution for use in the present invention. As the agent, one or more water-soluble silver halide solubilizers can be used, which include, for example, thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol; and thioureas. A particular bleach-fixing solution containing the fixing agent described in JP-A-55-155354 together with a large amount of a halide such as potassium iodide can also be used. In the present invention, thiosulfates, especially ammonium thiosulfate, are preferably used. The amount of the bleaching agent in the solution is preferably from 0.3 to 2 mol/liter, more preferably from 0.5 to 1.0 mol/liter. The pH range of the bleach-fixing solution or fixing solution for use in the present invention is preferably from 3 to 10, more preferably from 5 to 9.

The bleach-fixing solution may further contain other various brightening agents, defoaming agents or surfactants as well as organic solvents such as polyvinyl pyrrolidone or methanol.

The bleach-fixing solution or fixing solution contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite). The compound is preferably incorporated into the solution in an amount of approximately from about 0.02 to about 0.50 mol/liter, more preferably approximately from 0.04 to 0.40 mol/liter, as the sulfite ion.

As the preservative, sulfites are generally used, but ascorbic acid, carbonyl-bisulfite adducts or carbonyl compounds may also be added to the solution.

In addition, the solution may further contain a buffer, a brightening agent, a chelating agent, a defoaming agent and a fungicide, if desired.

After desilvered by fixation or bleach-fixation, the photographic material is generally rinsed in water and/or stabilized.

The amount of the water to be used in the rinsing step varies, depending upon the characteristics of the photographic material being processed (for example, the constituting elements such as couplers and others), the use of the material, the temperature of the rinsing water, the number of the rinsing baths (the number of rinsing stages), the replenishment system of normal current or countercurrent, and other various conditions, and therefore it may be defined in a broad range. For instance, the relation between the number of the rinsing tanks and the amount of the rinsing water in a multi-stage countercurrent rinsing system may be obtained by the method described in *Journal of the Society of Motion Picture and Television Engineering,* Vol. 64, pages 248 to 253 (May, 1955). In general, the number of the stages in a multi-stage countercurrent rinsing system is preferably from 2 to 6, especially preferably from 2 to 4.

In accordance with the multi-stage counter-current rinsing system, the amount of the rinsing water to be used may noticeably be reduced, and for example, the amount may be from 0.5 liters to one liter or less per $m^2$ of the photographic material being processed. Accordingly, the effect of the present invention is remarkable when the rinsing is effected by such system. However, the system faces the problem that bacteria would propagate in the rinsing tanks because of the increased residence time of the rinsing water in the tanks, so that the floating substances formed would adhere to the photographic material being processed.

As a means of overcoming the problem, the method of reducing calcium and magnesium in the water, described in JP-A-62-288838, can be employed extremely efficiently. In addition, isothiazolone compounds or thiabendazoles described in JP-A-57-8542; chlorine-containing microbicides such as sodium chloroisocyanurates described in JP-A-61-120145; benzotriazoles described in JP-A-61-267761; copper ions; as well as other microbicides described in H. Horiguchi, *Antibacterial and Antifungal Chemistry* (published by Sankyo Publishing Co., Japan, 1986), *Bactericidal and Fungicidal Techniques to Microorganisms* (edited by Association of Sanitary Technique and published by Association of Industrial Technique, Japan, 1982) and *Encyclopedia of Bactericidal and Fungicidal Agents* (edited by Nippon Bactericide and Fungicide Association, Japan, 1986), can also be used for overcoming the problem.

In addition, the rinsing water may further contain a surfactant as a water-cutting agent, as well as a chelating agent such as EDTA as a water softener.

Following the above-mentioned rinsing step or without the step, the material may be stabilized. The stabilizing solution to be used in the stabilizing step may contain a compound having a function of stabilizing the image formed. For instance, such compound includes an aldehyde compound such as formalin, a buffer for adjusting the film pH value to that suitable for stabilizing the dye formed, and an ammonium compound. In addition, the above-mentioned various fungicides and bactericides may be added to the stabilizing solution for the purpose of preventing propagation of bacteria or fungi in the solution or for the purpose of imparting a fungicidal property to the material processed.

Further, the solution may also contain a surfactant, a brightening agent and a hardening agent. Where the photographic material of the present invention is directly stabilized without the water-rinsing step, all the known methods, for example, described in JP-A-57-8543, JP-A-58-14834 and JP-A-60-220345 can be employed.

As a further preferred embodiment for stabilization step, chelating agents such as 1-hydroxyethylidene-1,1-diphosphonic acid or ethylenediamine-tetramethylenephosphonic acid as well a magnesium or bismuth compounds can be employed.

A rinsing solution may be employed as the water-rinsing solution or stabilizing solution in the step to be effected after the desilvering step.

The pH value in the water-rinsing step or stabilizing step is preferably from 4 to 10, more preferably from 5 to 8. The temperature in the step may be determined in accordance with the use and characteristics of the photographic material being processed. In general, it may be 15° C. to 45° C., preferably 20° C. to 40° C. The processing time in the step may be determined freely but it is preferably short, since the total processing time is desired to be reduced. Preferably, the time for the water-rinsing or stabilizing step is from 15 seconds to 1 minute and 45 seconds, more preferably from 30 seconds to 1 minute and 30 seconds.

The amount of the replenisher added to the step is preferably small, in order to reduce running cost, reduce drainage amount and achieve easy handlability.

The preferred amount of the replenisher added to the step is from 0.5 to 50 times, more preferably from 3 to 40 times, of the amount of the carryover from the previous bath per unit area of the photographic material being processed. Precisely, it is one liter or less, preferably 500 ml or less per $m^2$ of the material. Replenishment may be effected continuously or intermittently.

The solution as used in the rinsing step and/or in the stabilization step may be re-circulated to the previous bath. As one example of such re-circulation, the rinsing water is reduced by a multi-stage countercurrent system where the overflow of the rinsing solution is re-circulated to the previous bleach-fixation bath and a concentrated solution is replenished to the bleach-fixing bath. According to this system, the amount of the waste to be drained from the process may be reduced.

The following examples are intended to illustrate the present invention in more detail but not to limit it in any way.

EXAMPLE 1

25 g of lime-processed gelatin was added to 800 cc of distilled water and dissolved at 40° C., then 2.25 g of sodium chloride was added thereto, and the solution was heated up to 70° C. Subsequently, a solution of 5.0 g of silver nitrate dissolved in 140 cc of distilled water and a solution of 1.7 g of sodium chloride dissolved in 140 cc of distilled water were added and blended with the previously prepared solution at 70° C. over a period of 40 minutes.

Next, a solution of 57.5 g of silver nitrate dissolved in 160 cc of distilled water and a solution of 19.8 g of sodium chloride dissolved in 160 cc of distilled water were further added and blended therewith at 70° C. over a period of 40 minutes.

Additionally, a solution of 62.5 g of silver nitrate dissolved in 160 cc of distilled water and a solution of 21.5 g of sodium chloride dissolved in 160 cc of distilled water were added and blended therewith at 70° C. over a period of 40 minutes.

The resulting blend was de-salted and washed with water at 40° C., and 6.0 g of lime-processed gelatin was added to the washed blend, which was then adjusted to a pAg value of 7.9 and a pH value of 6.2 by adding sodium chloride and sodium hydroxide thereto.

After this was heated up to 50° C., $3\times10^{-4}$ mol per mol of silver halide of the following blue-sensitizing dye was added thereto. Then, this was most optimally gold-sulfur-sensitized with $1.4\times10^{-5}$ mol/kg mol of triethylthiourea and $0.7\times10^{-5}$ mol/kg mol of chloroauric acid. After gold-sulfur sensitization, $3\times10^{-4}$ mol per mol of silver halide of Compound (I-1) was added thereto. The silver chloride emulsion thus obtained was called Emulsion (A).

Blue-sensitizing Dye:

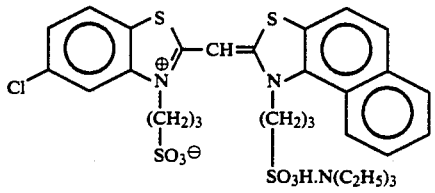

Other silver chloride emulsions (Emulsions (B) to (R)) were prepared in the same manner as in preparation of Emulsion (A), except that an aqueous solution containing the compound as indicated in Table 1 below was added to the reaction system along with the third addition of aqueous silver nitrate solution and aqueous sodium chloride solution thereto over a period of 40 minutes.

The grain shape, grain size and grain size distribution of each of these 18 emulsions (Emulsions (A) to (R)) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 18 emulsions (Emulsions (A) to (R)) contained cubic grains with very sharp edges, having a grain size of 0.92 micron and a grain size distribution of 0.11.

The surfaces of a paper support, both of which were laminated with polyethylene, were subjected to corona-discharging, and a gelatin-subbing layer containing sodium dodecylbenzenesulfonate was formed thereon. Then, plural photographic layers were coated over the subbing layer to form a multi-layer color photographic paper (Sample (A)). Coating compositions for the plural layers were prepared as mentioned below.

Preparation of First Layer-Coating Composition 27.2 g of ethyl acetate, 4.1 g of solvent (Solv-3) and 4.1 g of solvent (Solv-7) were added to 19.1 g of yellow coupler (ExY), 4.1 g of color image stabilizer (Cpd-1) and 0.7 g of color image stabilizer (Cpd-7) and dissolved, and the resulting solution was added to 185 cc of aqueous 10 % gelatin solution containing 8 cc of sodium dodecylbenzenesulfonate and then dispersed by emulsification with an ultrasonic homogenizer. The resulting dispersion was blended with the above-mentioned silver chloride emulsion (Emulsion (A) to prepare a first layer-coating composition.

Other coating compositions for the second layer to the seventh layer were prepared in the same manner as above. 1-Hydroxy-3,5-dichloro-s-triazine sodium salt was used as a gelatin-hardening agent in each layer.

(Cpd-1) and (Cpd-11) were added to each layer in an amount of 25 mg/m$^2$ and 50 mg/m$^2$ each as a total amount in the sample.

The following color-sensitizing dyes were added to the respective light-sensitive layers.

Sensitizing Dye (1) to Green-sensitive Emulsion Layer:

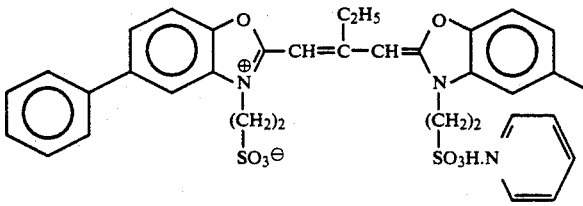

($4.0\times10^{-4}$ mol per mol of silver halide to large-size emulsion; $5.6\times10^{-4}$ mol per mol of silver halide to small-size emulsion)

Sensitizing Dye (2) to Green-sensitive Emulsion Layer:

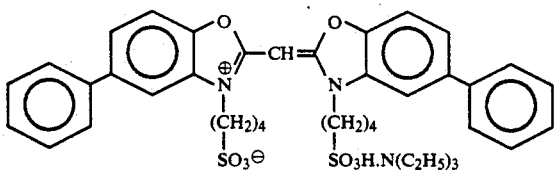

($7.0\times10^{-5}$ mol per mol of silver halide to large-size emulsion; $1.0\times10^{-5}$ mol per mol of silver halide to small-size emulsion)

Both dyes (1) and (2) were added to the green-sensitive emulsion layer.

Sensitizing Dye to Red-sensitive Emulsion Layer:

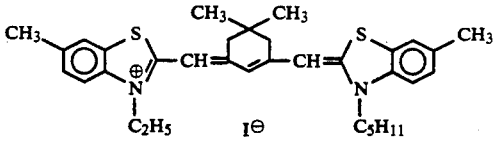

($0.9\times10^{-4}$ mol per mol of silver halide to large-size emulsion; $1.1\times10^{-4}$ mol per mol of silver halide to small-size emulsion)

To the red-sensitive emulsion layer was added the following compound in an amount of $2.6\times10^{-3}$ mol per mol of silver.

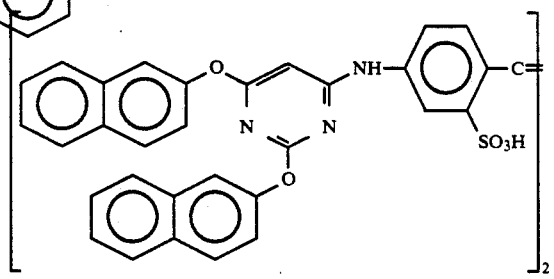

To the green-sensitive emulsion layer and the red-sensitive emulsion layer was added 1-(5-methyluredophenyl)-5-mercaptotetrazole in an amount of $7.7\times10^{-4}$ mol and $2.5\times10^{-4}$ mol, respectively, per mol of silver halide.

To the blue-sensitive emulsion layer and the green-sensitive emulsion layer was added 4-hydroxy-6-methyl-1,3,3a,7-tetraazaindene in an amount of $1\times10^{-4}$ mol and $2\times10^{-4}$ mol, respectively, per mol of silver halide.

The following dyes were added to the emulsion layer for anti-irradiation, each in the amount as parenthesized.

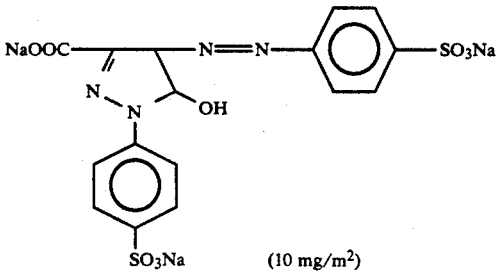

(10 mg/m$^2$)

-continued

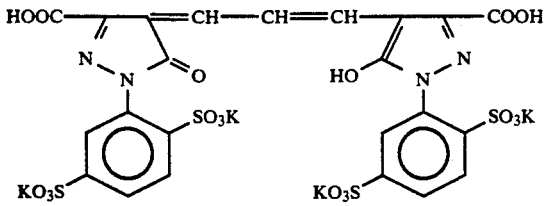

(10 mg/m²)

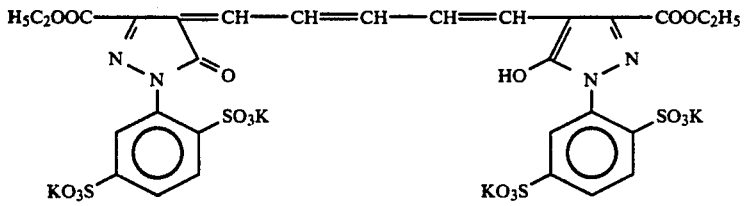

(40 mg/m²)

and

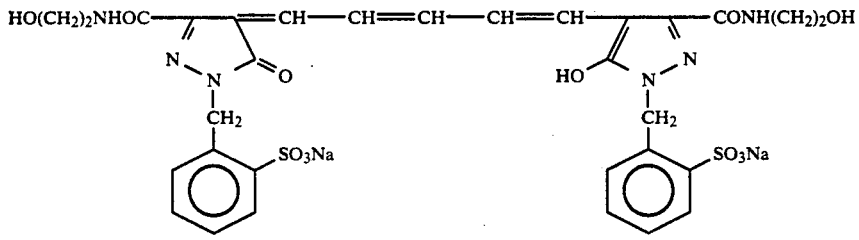

(20 mg/m²)

Constitution of Layers

Compositions of constituent layers are shown below. The number indicates the amount coated as a unit of g/m². The amount of silver halide emulsion coated was represented by the amount of silver therein.

Support

Polyethylene-laminated paper (containing white pigment ($TiO_2$) and bluish dye (ultramarine) in polyethylene below the first layer)

| | |
|---|---|
| First Layer (Blue-sensitive Emulsion Layer): | |
| Above-mentioned silver chloride Emulsion (A) | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |
| Second Layer (Color Mixing Preventing Layer): | |
| Gelatin | 0.99 |
| Color Mixing Preventing Agent (Cpd-5) | 0.08 |
| Solvent (Solv-1) | 0.16 |
| Solvent (Solv-4) | 0.08 |
| Third Layer (Green-sensitive Emulsion Layer): | |
| Silver chlorobromide Emulsion (⅓ (by mol of Ag) mixture of emulsion of large-size cubic grains with mean grain size of 0.55 micron and fluctuation coefficient of grain size distribution of 0.10 and emulsion of small-size cubic grains with mean grain size of 0.39 micron and fluctuation coefficient of grain size distribution of 0.08; both large-size and small-size grains locally had 0.8 mol % of AgBr on a part of the surface of the grain) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer): | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer (Red-sensitive Emulsion Layer): | |
| Silver chlorobromide Emulsion (¼ (by mol as Ag) mixture of emulsion of large-size cubic grains with mean grain size of 0.58 micron and fluctuation coefficient of grain size distribution of 0.09 and emulsion of small-size cubic grains with mean grain size of 0.45 micron and fluctuation coefficient of grain size distribution of 0.11; both large-size and small-size grains locally had 0.6 mol % of AgBr on a part of the surface of the grain) | 0.23 |
| Gelatin | 1.34 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |

-continued

| | |
|---|---|
| Color Image Stabilizer (Cpd-8) | 0.05 |
| Solvent (Solv-6) | 0.14 |
| Sixth Layer (Ultraviolet Absorbing Layer): | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer (Protective Layer): | |
| Gelatin | 1.33 |
| Acryl-modified Copolymer of Polyvinyl | 0.17 |
| Alcohol (modification degree 17%) | |
| Liquid Paraffin | 0.03 |

Compounds used above are as follows:

(ExY) Yellow Coupler

1/1 (by mol) mixture of the following compounds:

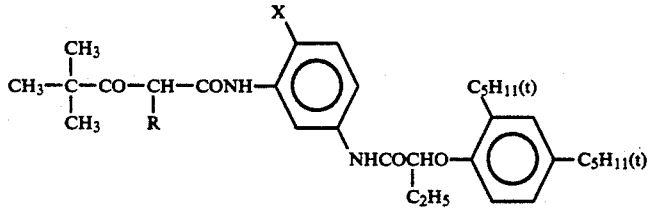

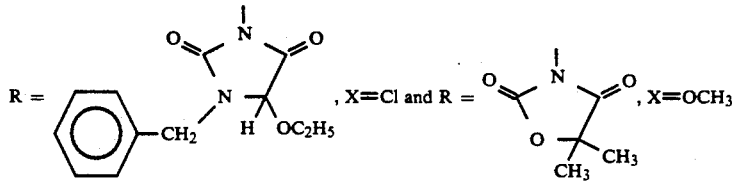

(ExM) Magenta Coupler:

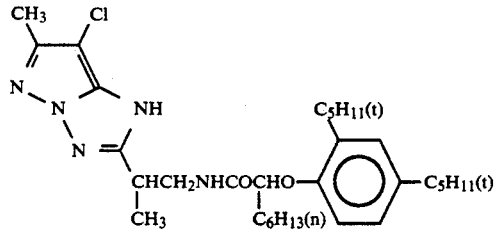

(ExC) Cyan Coupler

1/1 (by weight) mixture of the following compounds:

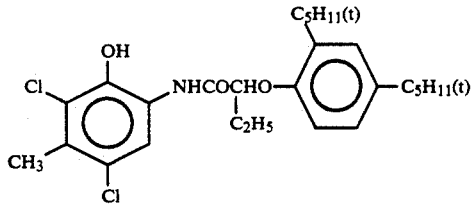

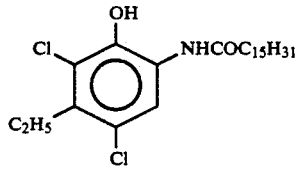

(Cpd-1) Color Image Stabilizer:

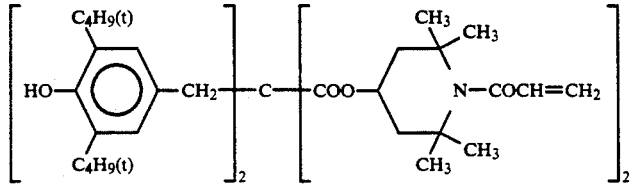

-continued (Cpd-2) Color Image Stabilizer:

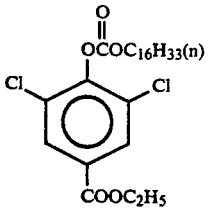

(Cpd-3) Color Image Stabilizer:

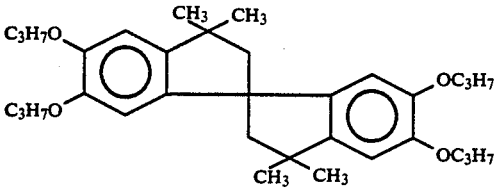

(Cpd-4) Color Image Stabilizer:

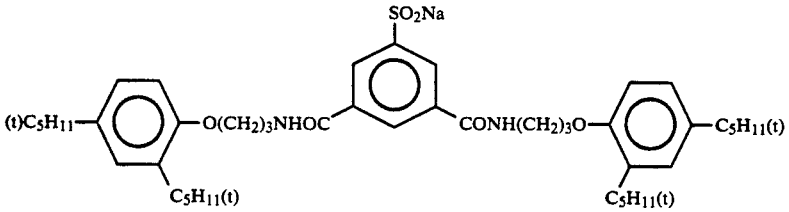

(Cpd-5) Color Mixing Preventing Agent:

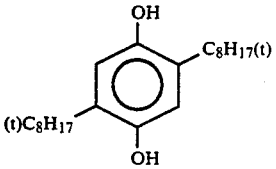

(Cpd-6) Color Image Stabilizer

2/4/4 (by weight) mixture of the following compounds:

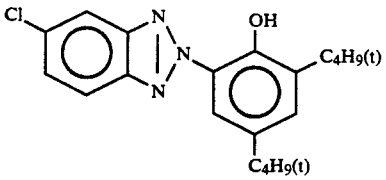

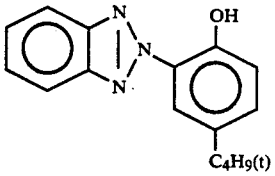

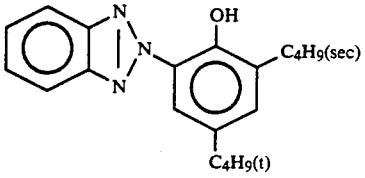

-continued (Cpd-7) Color Image Stabilizer:

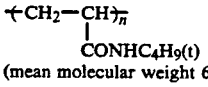

(mean molecular weight 60,000)

(Cpd-8) Color Image Stabilizer

1/1 (by weight) mixture of the following compounds:

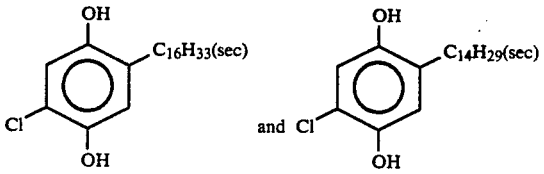

(Cpd-9) Color Image Stabilizer:

-continued

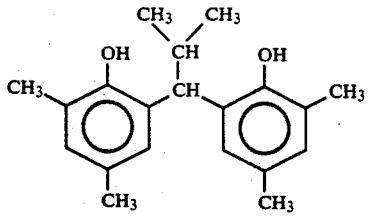

(Cpd-10) Antiseptic:

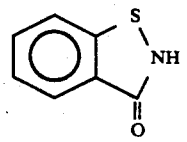

(Cpd-11) Antiseptic:

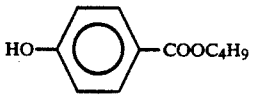

(UV-1) Ultraviolet Absorbent

4/2/4 (by weight) mixture of the following compounds:

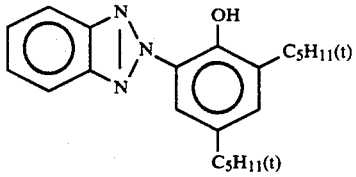

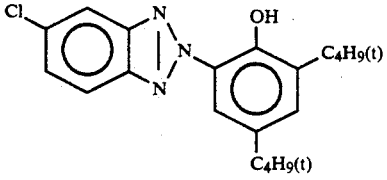

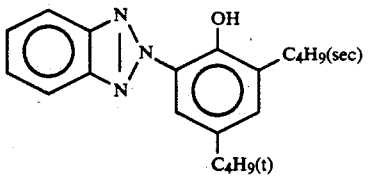

(Solv-1) Solvent:

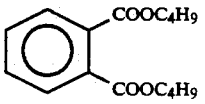

(Solv-2) Solvent

1/1 (by volume) mixture of the following compounds:

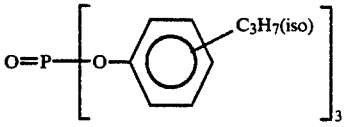

and

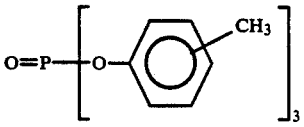

(Solv-3) Solvent:

$O{=}P{+}O{-}C_9H_{19}(iso)]_3$ (Solv-4) Solvent:

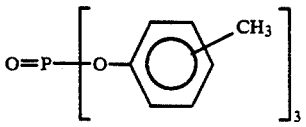

(Solv-5) Solvent

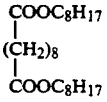

(Solv-6) Solvent

80/20 (by volume) mixture of the following compounds:

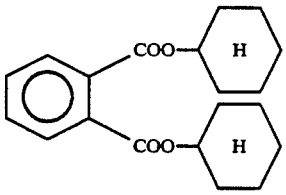

and

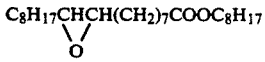

(Solv-7) Solvent:

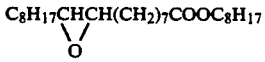

On the basis of the photographic material sample as prepared above, other photographic material samples (Samples (B) to (R)) were prepared in the same manner except that the emulsion in the blue-sensitive layer was varied as indicated in Table 1 below.

For the purpose of examining the sensitivity and gradation of the thus prepared 18 photographic material samples, these were separately exposed through an optical wedge and a blue filter for 10 seconds or $10^{-2}$ second, and the thus exposed samples were then processed in accordance with the process mentioned below, using the processing solutions also mentioned below, for color development.

For the purpose of examining the latent image storability of these photographic material samples, these samples were separately exposed through an optical wedge and a blue filter for $10^{-2}$ second, and after storage for 30 seconds and 3 hours, the exposed samples were processed in accordance with the process mentioned below, using the processing solutions also mentioned below, for color development.

For the purpose of examining the pressure-resistance of these photographic material samples, these samples were scratched with an iron needle having a diameter of 0.5 mm under a load of 100 g at a speed of 60 cm/s. Afterwards, these samples were color-developed for 35 seconds and then subjected to the subsequent processing.

| Processing Steps | Processing Steps | | | |
|---|---|---|---|---|
| | Temperature | Time | Replenisher* | Capacity of Tank |
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

*Amount of replenisher is per $m^2$ of sample being processed.

(Rinsing was effected by three-tank countercurrent system from rinsing tank (3) to rinsing tank (1).)

The processing solutions used in the above-mentioned steps had the following compositions.

| | Tank Solution | Replenisher |
|---|---|---|
| Color Development | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline Sulfate | 5.0 g | 7.0 g |
| N,N-bis(carboxymethyl)-hydrazine | 4.0 g | 5.0 g |
| N,N-di(sulfoethyl)hydroxylamine/Na | 4.0 g | 5.0 g |
| Brightening agent (WHITEX 4B, product by Sumitomo Chemical Co.) | 1.0 g | 2.0 g |
| Water to make | 1000 ml | 1000 ml |
| pH (25° C.) | 10.05 | 10.45 |
| Bleach-fixing Solution: (Tank solution and replenisher were same.) | | |
| Water | 400 ml | |
| Ammonium thiosulfate (70%) | 100 ml | |
| Sodium sulfite | 17 g | |
| Ammonium ethylenediaminetetraacetato/Iron (III) | 55 g | |
| Disodium ethylenediaminetetraacetate | 5 g | |
| Ammonium bromide | 40 g | |
| Water to make | 1000 ml | |
| pH (25° C.) | 6.0 | |
| Rinsing Solution: (Tank solution and replenisher were same.) | | |
| Ion-exchanged water (having a calcium content of 3 ppm or less and a magnesium content of 3 ppm or less). | | |

The reflection density of each of the thus processed samples was measured to obtain the characteristic curve. The sensitivity of each sample is a reciprocal of the amount of exposure necessary to give a density higher than the fog density by 0.5 and it is represented by the relative value based on the sensitivity of Sample (A) (as exposed for 10 seconds) of 100. The gradation is represented by the difference between the density of the amount of exposure larger than the amount of exposure for obtaining the sensitivity by 0.5 as log E and the density for obtaining the sensitivity of the sample. The results obtained are shown in Table 1 below.

For evaluating the latent image storability, the difference in the sensitivity between the sample as processed in 30 seconds after exposure and that as processed in 3 hours after exposure was measured. The sensitivity difference is represented by the difference in the logarithmic value of the amount of exposure necessary for giving a density higher than the fog density by 0.5. The positive logarithmic value indicates sensitization of the latent image; while the negative logarithmic value indicates fading of the latent image.

For evaluating the pressure-resistance of the samples, the samples as scratched before processing were observed with the naked eye. The pressure-resistance was evaluated on the basis of the following criteria.

○: No fog by scratching was admitted.

Δ: Slight fog by scratching was admitted.

×: Distinct fog by scratching was admitted.

These results are shown in Table 1 below.

TABLE 1

| Emulsion/ Sample | Compound Added | Amount Added | 10-second exposure | | $10^{-2}$-second exposure | | Latent Image Storability | Pressure-Resistance | Remarks |
|---|---|---|---|---|---|---|---|---|---|
| | | | Sensitivity | Gradation | Sensitivity | Gradation | | | |
| A | — | — | 100 | 1.25 | 85 | 1.06 | −0.03 | ○ | Comparison |
| B | $K_3Fe(CN)_6$ | $1 \times 10^{-6}$ | 115 | 1.23 | 105 | 1.09 | −0.01 | Δ | Comparison |
| C | $K_3Fe(CN)_6$ | $1 \times 10^{-5}$ | 125 | 1.16 | 120 | 1.07 | +0.03 | X | Comparison |
| D | $K_3Fe(CN)_6$ | $1 \times 10^{-4}$ | 158 | 0.98 | 155 | 0.87 | +0.04 | X | Comparison |
| E | $K_4Ru(CN)_6$ | $1 \times 10^{-6}$ | 120 | 1.22 | 115 | 1.13 | +0.02 | Δ | Comparison |
| F | $K_4Ru(CN)_6$ | $1 \times 10^{-5}$ | 135 | 1.20 | 133 | 1.12 | +0.06 | X | Comparison |
| G | $K_4Ru(CN)_6$ | $1 \times 10^{-4}$ | 138 | 1.25 | 135 | 1.20 | +0.09 | X | Comparison |
| H | $K_3IrCl_6$ | $2 \times 10^{-8}$ | 92 | 1.25 | 88 | 1.18 | +0.05 | ○ | Comparison |
| I | $K_3IrCl_6$ | $4 \times 10^{-8}$ | 80 | 1.28 | 81 | 1.25 | +0.15 | ○ | Comparison |
| J | $K_3IrBr_6$ | $4 \times 10^{-8}$ | 75 | 1.18 | 75 | 1.16 | +0.21 | ○ | Comparison |
| K | $K_2PtCl_4$ | $1 \times 10^{-5}$ | 96 | 1.23 | 83 | 1.09 | +0.01 | ○ | Comparison |
| L | $K_2PtCl_4$ | $1 \times 10^{-4}$ | 90 | 1.22 | 78 | 1.08 | +0.02 | ○ | Comparison |
| M | $K_3Ir(CN)_6$ | $5 \times 10^{-7}$ | 120 | 1.25 | 113 | 1.18 | −0.01 | ○ | Invention |
| N | $K_3Ir(CN)_6$ | $1 \times 10^{-6}$ | 130 | 1.26 | 128 | 1.20 | +0.01 | ○ | Invention |
| O | $K_3Ir(CN)_6$ | $1 \times 10^{-5}$ | 135 | 1.28 | 135 | 1.27 | +0.01 | ○ | Invention |
| P | $K_3Ir(CN)_6$ | $1 \times 10^{-4}$ | 135 | 1.28 | 137 | 1.28 | +0.02 | ○ | Invention |

TABLE 1-continued

| Emulsion/ Sample | Compound Added | Amount Added | 10-second exposure Sensitivity | 10-second exposure Gradation | $10^{-2}$-second exposure Sensitivity | $10^{-2}$-second exposure Gradation | Latent Image Storability | Pressure-Resistance | Remarks |
|---|---|---|---|---|---|---|---|---|---|
| Q | $K_2Pt(CN)_4$ | $1 \times 10^{-4}$ | 129 | 1.24 | 125 | 1.23 | −0.02 | ○ | Invention |
| R | $K_2Pt(CN)_4$ | $5 \times 10^{-4}$ | 125 | 1.24 | 127 | 1.24 | −0.01 | ○ | Invention |

Amount added is represented by the number of mols per mol of silver halide.
Sensitivity is represented as a relative value to the sensitivity of 10-second exposed Sample (A) of being 100.
Where the value of gradation is larger, the sample is harder.
Where the absolute value of the latent image storability is smaller, the sample is more stable.

As is obvious from the results shown in Table 1 above, Samples (B), (C) and (D) having a $K_3Fe(CN)_6$-added emulsion had a poor pressure-resistance although Samples (B), (C) and (D) had a high sensitivity. In particular, Sample (D) containing a large amount of the additive was noted to be extremely softened.

Samples (E), (F) and (G) to which $K_4Ru(CN)_6$ had been added also had a poor pressure-resistance, although these Samples were not softened as much even though the amount of the additive was large.

However, Samples (F) and (G) containing a large amount of the additive also had a poor latent image storability.

Samples (H), (I), (J), (K) and (L) to which $K_3IrCl_6$, $K_3IrBr_6$ or $K_2PtCl_4$ had been added did not have an elevated sensitivity; and Samples (H), (I) and (J) to which $K_3IrCl_6$ or $K_3IrBr_6$ had been added had an extremely poor latent image storability.

In contrast, Samples (M), (N), (0), (P), (Q) and (R) of the present invention to which $K_3Ir(CN)_6$ or $K_2Pt(CN)_6$ had been added had an improved sensitivity without worsening the pressure-resistance and the latent image storability. Additionally, these samples of the present invention had little fluctuation of the sensitivity and gradation where the intensity of the light applied for exposure varied. The same results were also obtained when $Re(CN)_6^{4-}$ or $Os(CN)_6^{4-}$ was used instead of $Ru(CN)_6^{4-}$.

EXAMPLE 2

32 g of lime-processed gelatin was added to 800 cc of distilled water and dissolved at 40° C., then 3.3 g of sodium chloride was added thereto, and the solution was heated up to 60° C. 1.8 cc of N,N'-dimethylimidazolidine-2-thione (1% aqueous solution) was added to the resulting solution. Subsequently, a solution of 32.0 g of silver nitrate dissolved in 200 cc of distilled water and a solution of 11.0 g of sodium chloride dissolved in 200 cc of distilled water were added to and blended with the previously prepared solution at 60° C. over a period of 14 minutes.

Next, a solution of 128,0 g of silver nitrate dissolved in 560 cc of distilled water and a solution of 44.0 g of sodium chloride dissolved in 560 cc of distilled water were further added and blended therewith at 60° C. over a period of 40 minutes.

The resulting blend was de-salted and washed with water at 40° C., and 90.0 g of lime-processed gelatin was added to the washed blend, which was then adjusted to a pAg value of 8.0 and a pH value of 7.2 by adding sodium chloride and sodium hydroxide thereto. After $8 \times 10^{-5}$ mol per mol of silver halide of the following red-sensitizing dye was added thereto, this was optimally sulfur-sensitized with triethylthiourea at 50° C. After sulfur-sensitization, $5 \times 10^{-4}$ mol per mol of silver hal of Compound (I-1) was added thereto. The silver chloride emulsion thus obtained was called Emulsion (S).

Red-sensitizing Dye:

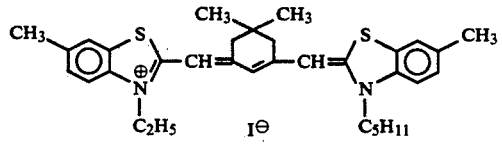

Another silver chloride emulsion (Emulsion (T) ) was prepared in the same manner as in preparation of Emulsion (S), except that an aqueous solution containing $3 \times 10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (U)) was prepared also in the same manner as in preparation of Emulsion (S) except that the emulsion was gold-sensitized with chloroauric acid in place of being sulfur-sensitized with triethylthiourea.

Another emulsion (Emulsion (V)) was prepared also in the same manner as in preparation of Emulsion (U) except that an aqueous solution containing $3 \times 10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (W)) was prepared also in the same manner as in preparation of Emulsion (S) except that the emulsion was optimally gold-sulfur-sensitized with triethylthiourea and chloroauric acid in the same manner as in Example 1 in place of being sulfur-sensitized with triethylthiourea only.

Another emulsion (Emulsion (X)) was prepared also in the same manner as in preparation of Emulsion (W) except that an aqueous solution containing $3 \times 10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (Y)) was prepared also in the same manner as in preparation of Emulsion (W) except that $7 \times 10^{-4}$ mol per mol of silver halide of 4-hydroxy-6-methyl-1,3,3a,7-tetraazaindene (TAI) was added to the emulsion after gold-sulfur sensitization thereof in place of compound (I-1).

Another emulsion (Emulsion (Z)) was prepared also in the same manner as in preparation of Emulsion (Y) except that an aqueous solution containing $3 \times 10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (a)) was prepared also in the same manner as in preparation of Emulsion (W) except that $8\times10^{-4}$ mol per mol of silver halide of compound (II-1) was added to the emulsion after gold-sulfur sensitization thereof in place of compound (I-1).

Another emulsion (Emulsion (b)) was prepared also in the same manner as in preparation of Emulsion (a) except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 40 minutes.

The grain shape, grain size and grain size distribution of each of these 10 emulsions (Emulsions (S) to (b)) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 10 emulsions (Emulsions (S) to (b)) contained cubic grains with very sharp edges, having a grain size of 0.54 micron and a grain size distribution of 0.09.

Photographic material samples (Samples (S) to (b)) were prepared in the same manner as in preparation of Sample (A) in Example 1, except that the emulsion in the fifth layer (red-sensitive emulsion layer) was replaced by any one of the emulsions prepared above (Emulsions (S) to (b), respectively) as indicated in Table 2 below and potassium bromide was added to the fifth layer-coating composition in an amount of 0.3 mol % per mol of silver in the red-sensitive emulsion.

The sensitivity, gradation, latent image storability and pressure-resistance of each of the thus prepared samples were evaluated in the same manner as in Example 1. However, exposure of the samples was effected through a red filter. The results obtained are shown in Table 2 below.

and gradation to be caused by variation of the intensity of the light for exposure was also great. Additionally, in the latter gold-sensitized or gold-sulfur-sensitized emulsions, latent image fading was reduced. These effects were greater in the samples where compound (I-1) or (II-1) had been added to the red-sensitive emulsion, as is apparent from the results of Table 2.

EXAMPLE 3

32 g of lime-processed gelatin was added to 800 cc of distilled water and dissolved at 40° C., then 5.7 g of sodium chloride was added thereto, and the solution was heated up to 75° C. 1.8 cc of N,N'-dimethylimidazolidine-2-thione (1% aqueous solution) was added to the resulting solution. Subsequently, a solution of 100 g of silver nitrate dissolved in 400 cc of distilled water and a solution of 34.4 g of sodium chloride dissolved in 400 cc of distilled water were added to and blended with the previously prepared solution at 75° C. over a period of 53 minutes.

Next, a solution of 60 g of silver nitrate dissolved in 200 cc of distilled water and a solution of 17.4 g of sodium chloride dissolved in 200 cc of distilled water were further added and blended therewith at 75° C. over a period of 18 minutes.

The resulting blend was de-salted and washed with water at 40° C., and 90.0 g of lime-processed gelatin was added to the washed blend, which was then adjusted to a pAg value of 7.5 and a pH value of 6.5 by adding sodium chloride and sodium hydroxide thereto. After $3\times10^{-4}$ mol per mol of silver halide of the blue-sensitizing dye used in Emulsion A of Example 1 was added thereto, this was optimally gold-sulfur-sensitized with triethylthiourea and chloroauric acid in the same manner as in Example 1. After gold-sulfur sensitization, $3\times10^{-4}$ mol per mol of silver halide of Compound (I-1) was added thereto. The silver chloride emulsion thus obtained was called Emulsion (c).

Another silver chloride emulsion (Emulsion (d)) was prepared in the same manner as in preparation of Emulsion (c), except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 18 minutes.

Another silver chlorobromide emulsion (Emulsion (e)) was prepared also in the same manner as in prepara-

TABLE 2

| Emulsion/ Sample | Chemical Sensitization | Compound Added after Chemical Sensitization | Addition of $K_3IrCN_6$ | 10-second exposure Sensitivity | 10-second exposure Gradation | $10^{-2}$-second exposure Sensitivity | $10^{-2}$-second exposure Gradation | Latent Image Storability | Pressure Resistance | Remarks |
|---|---|---|---|---|---|---|---|---|---|---|
| S | Sulfur | (I-1) | No | 100 | 1.28 | 80 | 1.08 | −0.07 | ○ | Comparison |
| T | Sulfur | (I-1) | Yes | 106 | 1.28 | 87 | 1.05 | −0.06 | Δ | Comparison |
| U | Gold | (I-1) | No | 180 | 1.27 | 160 | 1.19 | −0.05 | ○ | Comparison |
| V | Gold | (I-1) | Yes | 230 | 1.30 | 225 | 1.27 | −0.02 | ○ | Invention |
| W | Gold-Sulfur | (I-1) | No | 235 | 1.27 | 210 | 1.07 | −0.06 | ○ | Comparison |
| X | Gold-Sulfur | (I-1) | Yes | 340 | 1.30 | 340 | 1.29 | −0.01 | ○ | Invention |
| Y | Gold-Sulfur | (TAI) | No | 215 | 1.26 | 195 | 1.06 | −0.05 | ○ | Comparison |
| Z | Gold-Sulfur | (TAI) | Yes | 225 | 1.24 | 210 | 1.18 | −0.03 | ○ | Invention |
| a | Gold-Sulfur | (II-1) | No | 210 | 1.26 | 195 | 1.10 | −0.06 | ○ | Comparison |
| b | Gold-Sulfur | (II-1) | Yes | 270 | 1.27 | 270 | 1.25 | −0.01 | ○ | Invention |

Sensitivity is represented as a relative value to the sensitivity of 10-second exposed Sample (S) of 100.
Where the value of gradation is larger, the sample is harder.
Where the absolute value of the latent image storbility is smaller, the sample is more stable.

As is obvious from the results in Table 2 above, in the emulsions which were only sulfur-sensitized, the increase of the sensitivity caused by addition of $K_3Ir(CN)_6$ was small of the additive for preventing the fluctuation of the sensitivity and gradation caused by variation of the intensity of the light for exposure was also small. As opposed to such sulfur-sensitized emulsions, in the emulsions as gold-sensitized or gold-sulfur-sensitized, the elevation of the sensitivity caused by addition of $K_3Ir(CN)_6$ was great and the effect of the additive for preventing the fluctuation of the sensitivity tion of Emulsion (c) except that an additional emulsion of ultra-fine silver bromide grains (having a grain size of 0.05 micron) was added to the emulsion, prior to gold-sulfur sensitization thereof, in an amount of 0.3 mol % as silver bromide, at 58° C., then ripened for 15 minutes, and thereafter the resulting emulsion was optimally gold-sulfur-sensitized.

Another silver chlorobromide emulsion (Emulsion (f)) was prepared also in the same manner as in preparation of Emulsion (e) except that an aqueous solution containing $3\times10^{-5}$mol per mol of silver halide of $K_3Ir(CN)_6$ was added to the reaction system along with the second addition of aqueous silver nitrate solution and aqueous sodium chloride solution thereto over a period of 18 minutes.

Other silver chlorobromide emulsions (Emulsions (g), (i) and (k)), each having a silver bromide content of 4 mol %, 18 mol % and 25 mol %, respectively, were prepared in the same manner as preparation of Emulsion (c) except that potassium bromide was incorporated into both sodium chloride solutions for the first and second addition. However, in order that the grain size of these emulsions (Emulsions (g), (i) and (k)) was made same as that of Emulsion (c), the amount of N,N'-dimethylimidazolidine-2-thione to be added and the temperature in formation of the grains were suitably varied.

Other silver chlorobromide emulsions (Emulsions (h), (j) and (l) were prepared in the same manner as in preparation of Emulsions (g), (i) and (k), respectively, except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 18 minutes.

The grain shape, grain size and grain size distribution of each of these 10 emulsions (Emulsions (c) to (l)) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 10 emulsions (Emulsions (c) to (l)) contained cubic grains, having a grain size of 0.82 micron and a grain size distribution of from 0.10 to 0.12.

It was noted from the electronic microscopic photographs that the grains in Emulsions (e) and (f) to which ultra-fine silver bromide grains had been added were sharper on every corner edge than those in Emulsions (c) and (d) to which such grains had not been added. The X-ray diffraction curve of each of Emulsions (e) and (f) showed a weak diffraction at the part corresponding to the silver bromide content of from 10 mol % to 40 mol %. From the facts, it is determined that the grains in Emulsions (e) and (f) were cubic silver chloride grains having a silver bromide-rich localized phase (having a silver bromide content of from 10 mol % to 40 mol %) on the corners of the grain as grown thereon by epitaxial growth.

Photographic material samples (Samples (c) to (l)) were prepared in the same manner as in preparation of Sample (A) in Example 1, except that the emulsion in the first layer (blue-sensitive emulsion layer) was replaced by any one of the emulsions prepared above (Emulsions (c) to (l), respectively) as indicated in Table 3 below.

The sensitivity, gradation, latent image storability and pressure-resistance of each of the thus prepared 10 samples were evaluated in the same manner as in Example 1. The results obtained are shown in Table 3 below.

TABLE 3

| Emulsion/ Sample | AgBr Content (mol %) | Addition of $K_3IrCN_6$ | 10-second exposure | | $10^{-2}$-second exposure | | Latent Image Storability | Pressure Resistance | Remarks |
|---|---|---|---|---|---|---|---|---|---|
| | | | Sensitivity | Gradation | Sensitivity | Gradation | | | |
| c | 0 | No | 100 | 1.30 | 72 | 1.02 | −0.04 | ○ | Comparison |
| d | 0 | Yes | 145 | 1.32 | 140 | 1.30 | +0.01 | ○ | Invention |
| e | 0.3 | No | 165 | 1.36 | 130 | 1.10 | −0.05 | ○ | Comparison |
| f | 0.3 | Yes | 220 | 1.38 | 222 | 1.35 | +0.01 | ○ | Invention |
| g | 4 | No | 130 | 1.26 | 96 | 1.12 | −0.07 | ○ | Comparison |
| h | 4 | Yes | 155 | 1.28 | 145 | 1.26 | −0.03 | ○ | Invention |
| i | 18 | No | 160 | 1.15 | 140 | 1.04 | −0.07 | ○ | Comparison |
| j | 18 | Yes | 180 | 1.16 | 170 | 1.12 | −0.04 | ○ | Invention |
| k | 25 | No | 150 | 1.18 | 135 | 1.04 | −0.08 | ○ | Comparison |
| l | 25 | Yes | 152 | 1.17 | 137 | 1.05 | −0.07 | ○ | Comparison |

Sensitivity is represented as a relative value to the sensitivity of 10-second exposed Sample (c) of 100.
Where the value of gradation is larger, the sample is harder.
Where the absolute value of the latent image storability is smaller, the smaple is more stable.

As is obvious from the results in Table 3 above, in the emulsion having a high silver bromide content (Emulsion (1)), the increase of the sensitivity caused by addition of $K_3Ir(CN)_6$ was small and the effect of the additive for preventing the fluctuation of the sensitivity and gradation caused by variation of the intensity of the light for exposure was also small. In contrast, in the pure silver chloride emulsion (Emulsion (d)) or the low silver bromide emulsions (Emulsions (f), (h) and (j)), the elevation of the sensitivity to be caused by addition of $K_3Ir(CN)_6$ was great and the effect of the additive for preventing the fluctuation of the sensitivity and gradation caused by variation of the intensity of the light for exposure was also great. Additionally, in the latter pure silver chloride or low silver bromide emulsions, latent image fading was reduced.

EXAMPLE 4

25 g of lime-processed gelatin was added to 800 cc of distilled water and dissolved at 40° C., then 2.25 g of sodium chloride was added thereto, and the solution was heated up to 70° C. Subsequently, a solution of 5.0 g of silver nitrate dissolved in 140 cc of distilled water and a solution of 1.7 g of sodium chloride dissolved in 140 cc of distilled water were added to and blended with the previously prepared solution at 70° C. over a period of 40 minutes.

Next, a solution of 120 g of silver nitrate dissolved in 320 cc of distilled water and a solution of 1.3 g of sodium chloride dissolved in 320 cc of distilled water were further added and blended therewith at 70° C. over a period of 80 minutes. The resulting blend was de-salted and washed with water at 40° C., and 6.0 g of lime-processed gelatin was added to the washed blend, which was then adjusted to a pAg value of 7.9 and a pH value of 6.2 by adding sodium chloride and sodium hydroxide thereto. After this was heated up to 50° C., $3\times10^{-4}$ mol per mol of silver halide of the same blue-sensitizing dye as that used in Example 1 was added thereto. Then this was optimally gold-sulfur-sensitized with triethylthiourea and chloroauric acid in the same manner as in Example 1. After gold-sulfur sensitization, $3\times10^{-4}$ per mol of silver halide of Compound (I-1) was added thereto. The silver chloride emulsion thus obtained was called Emulsion (m).

Another silver chloride emulsion (Emulsion (n)) was prepared in the same manner as in preparation of Emulsion (m), except that an aqueous solution of $5\times10^{-5}$ mol per mol of silver halide of $K_3Ir(CN)_6$ was added to the reaction system during the course ranging from initiation of the addition of the aqueous silver nitrate solution to completion of the addition of the same at a speed always having a constant rate relative to the concentration of the silver nitrate in the reaction system. It is considered that the resulting emulsion (Emulsion (n)) contained $[Ir(CN)_6]^{-3}$ almost uniformly in the grains.

Another silver chloride emulsion (Emulsion (o)) was prepared in the same manner as in preparation of Emulsion (m), except that an aqueous solution of $5\times10^{-5}$ mol per mol of silver halide of $K_3Ir(CN)_6$ was added to the reaction system during the course ranging from initiation of the addition of the aqueous silver nitrate solution to the time by which 50% of the whole amount of silver nitrate was added, at a speed always having a constant rate relative to the concentration of the silver nitrate in the reaction system.

Another silver chloride emulsion (Emulsion (p)) was prepared in the same manner as in preparation of Emulsion (m), except that an aqueous solution of $5\times10^{-5}$ mol per mol of silver halide of $K_3Ir(CN)_6$ was added to the reaction system after 4% of the whole amount of silver nitrate had been added to the reaction system and before 54% of the whole amount of the same was added thereto, at a speed always having a constant rate relative to the concentration of the silver nitrate in the reaction system.

Another silver chloride emulsion (Emulsion (q)) was prepared in the same manner as in preparation of Emulsion (m), except that an aqueous solution of $5\times10^{-5}$ mol per mol of silver halide of $K_3Ir(CN)_6$ was added to the reaction system after 4% of the whole amount of silver nitrate had been added to the reaction system and before completion of addition of all silver nitrate thereto, at a speed always having a constant rate relative to the concentration of the silver nitrate in the reaction system.

Another silver chloride emulsion (Emulsion (r)) was prepared in the same manner as in preparation of Emulsion (m), except that an aqueous solution of $5\times10^{-5}$ mol per mol of silver halide of $K_3Ir(CN)_6$ was added to the reaction system after 50% of the whole amount of silver nitrate had been added to the reaction system and before 80% of the whole amount of the same was added thereto, at a speed always having a constant rate relative to the concentration of the silver nitrate in the reaction system.

Another silver chloride emulsion (Emulsion (s)) was prepared in the same manner as in preparation of Emulsion (m), except that an aqueous solution of $5\times10^{-5}$ mol per mol of silver halide of $K_3Ir(CN)_6$ was added to the reaction system after 50% of the whole amount of silver nitrate had been added to the reaction system and before completion of addition of all silver nitrate thereto, at a speed always having a constant rate relative to the concentration of the silver nitrate in the reaction system.

Another silver chloride emulsion (Emulsion (t)) was prepared in the same manner as in preparation of Emulsion (m), except that an aqueous solution of $5\times10^{-5}$ mol per mol of silver halide of $K_3Ir(CN)6$ was added to the reaction system after 80% of the whole amount of silver nitrate had been added to the reaction system and before completion of addition of all silver nitrate thereto, at a speed always having a constant rate relative to the concentration of the silver nitrate in the reaction system.

The grain shape, grain size and grain size distribution of each of these 8 emulsions (Emulsions (m) to (t)) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 8 emulsions (Emulsions (m) to (t)) contained cubic grains with very sharp edges, having a grain size of 0.92 micron and a grain size distribution of from 0.11.

Photographic material samples (Samples (m) to (t)) were prepared in the same manner as in preparation of Sample (A) in Example 1, except that the emulsion in the first layer (blue-sensitive emulsion layer) was replaced by any one of the emulsions prepared above (Emulsions (m) to (t), respectively) as indicated in Table 4 below.

The sensitivity, gradation, latent image storability and pressure-resistance of each of the thus prepared 8 samples were evaluated in the same manner as in Example 1. The results obtained are shown in Table 4 below.

TABLE 4

| Emulsion/ | Addition of of $K_3IrCN_6$ (%) | | 10-second exposure | | $10^{-2}$-second exposure | | Latent Image | Pressure- | |
|---|---|---|---|---|---|---|---|---|---|
| Sample | Start | Finish | Sensitivity | Gradation | Sensitivity | Gradation | Storability | Resistance | Remarks |
| m | — | — | 100 | 1.27 | 83 | 1.04 | −0.04 | ○ | Comparison |
| n | 0 | 100 | 124 | 1.24 | 122 | 1.20 | +0.01 | ○ | Invention |
| o | 0 | 50 | 124 | 1.23 | 120 | 1.18 | −0.01 | Δ | Invention |
| p | 4 | 54 | 123 | 1.21 | 118 | 1.16 | −0.01 | Δ | Invention |
| q | 4 | 100 | 126 | 1.24 | 125 | 1.23 | +0.01 | ○ | Invention |
| r | 50 | 80 | 129 | 1.28 | 127 | 1.25 | +0.01 | ○ | Invention |
| s | 50 | 100 | 132 | 1.29 | 130 | 1.27 | +0.01 | ○ | Invention |

TABLE 4-continued

| Emulsion/ Sample | Addition of of $K_3IrCN_6$ (%) Start | Finish | 10-second exposure Sensitivity | Gradation | $10^{-2}$-second exposure Sensitivity | Gradation | Latent Image Storability | Pressure-Resistance | Remarks |
|---|---|---|---|---|---|---|---|---|---|
| t | 80 | 100 | 139 | 1.32 | 139 | 1.32 | +0.01 | ○ | Invention |

The amount of $K_3IrCN_6$ added at the start of addition and at the finish thereof was represented by percentage (%) with respect to the total amount of silver nitrate used for formation of grains.

Sensitivity was represented as a relative value to the sensitivity of 10-second exposed Sample (m) of 100.

Where the value of gradation is larger, the smaple is harder.

Where the absolute value of the latent image storability is smaller, the sample is more stable.

As is obvious from the results in Table 4 above, in the emulsions (Emulsions (o) and (p)) where $K_3Ir(CN)_6$ had been incorporated into the grains only in the vicinity of the center of the grain, the increase of the sensitivity caused by addition of $K_3Ir(CN)_6$ was not satisfactorily large and the effect of the additive for preventing the fluctuation of the sensitivity and gradation caused by variation of the intensity of the light for exposure was also not satisfactorily large. In addition, the pressure-resistance of such emulsions was somewhat lowered.

In contrast, in the other emulsions (Emulsions (r), (s) and (t)) where $K_3Ir(CN)_6$ had been incorporated into the grains in the vicinity of the surface layer of the silver halide grain, the elevation of the sensitivity caused by addition of $K_3Ir(CN)_6$ was great and the effect by the additive of preventing the fluctuation of the sensitivity and gradation caused by variation of the intensity of the light for exposure was also great, without worsening the pressure-resistance. Accordingly, it is noted that the latter emulsions (Emulsions (r), (s) and (t)) are more preferred embodiments of the present invention.

EXAMPLE 5

25 g of lime-processed gelatin was added to 800 cc of distilled water and dissolved at 40° C., then 2.25 g of sodium chloride was added thereto, and the whole was heated up to 70° C. Subsequently, a solution of 5.0 g of silver nitrate dissolved in 140 cc of distilled water and a solution of 1.7 g of sodium chloride dissolved in 140 cc of distilled water were added to and blended with the previously prepared solution at 70° C. over a period of 40 minutes.

Next, a solution of 57.5 g of silver nitrate dissolved in 160 cc of distilled water and a solution of 19.8 g of sodium chloride dissolved in 160 cc of distilled water were further added and blended therewith at 70° C. over a period of 40 minutes.

Additionally, a solution of 62.5 g of silver nitrate dissolved in 160 cc of distilled water and a solution of 21.5 g of sodium chloride dissolved in 160 cc of distilled water were added and blended therewith at 70° C. over a period of 40 minutes. The resulting blend was desalted and washed with water at 40° C., and 6.0 g of lime-processed gelatin was added to the washed blend, which was then adjusted to have a pAg value of 7.9 and a pH value of 6.2 by adding sodium chloride and sodium hydroxide thereto.

After this was heated up to 58° C., $3\times10^{-4}$ mol per mol of silver halide of the same blue-sensitizing dye as used in Emulsion A of Example 1 was added thereto. Then an emulsion of ultra-fine silver bromide grains (having grain size of 0.05 micron) was added thereto in an amount of 0.3 mol % as silver bromide content, and the resulting emulsion blend was ripened for 15 minutes. This was sulfur-sensitized with triethylthiourea. After sulfur-sensitization, $3\times10^{-4}$ mol per mol of silver halide of Compound (I-1) was added thereto. The silver chloride emulsion thus obtained was called Emulsion (A').

Other silver chloride emulsions (Emulsions (B') to (R')) were prepared in the same manner as in preparation of Emulsion (A'), except that an aqueous solution containing the compound as indicated in Table 5 below was added to the reaction system along with the third addition of aqueous silver nitrate solution and aqueous sodium chloride solution thereto over a period of 40 minutes.

The grain shape, grain size and grain size distribution of each of these 18 emulsions (Emulsions (A') to (R')) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size.

All 18 emulsions (Emulsions (A') to (R')) contained cubic grains with very sharp edges, having a grain size of 0.92 micron and a grain size distribution of 0.11. The X-ray diffraction curve of each of these emulsions showed a weak diffraction at the part corresponding to the silver bromide content of from 10 mol % to 40 mol %. From the facts, it is determined that the grains in these emulsions were cubic silver chloride grains having a silver bromide-rich localized phase (having a silver bromide content of from 10 mol % to 40 mol %) on the corners of the grain as grown thereon by epitaxial growth.

The surfaces of a paper support, both of which were laminated with polyethylene, was subjected to corona-discharging, and a gelatin-subbing layer containing sodium dodecylbenzenesulfonate was formed thereon. Then, seven photographic layers were coated over the subbing layer to form a multi-layer color photographic paper (Sample (A')), in the same manner as in Example 1.

On the basis of the photographic material sample as prepared above (Sample (A')), other photographic material samples (Samples (B') to (R')) were prepared in the same manner except that the emulsion in the blue-sensitive layer was varied as indicated in Table 5 below.

The sensitivity, gradation, latent image storability and pressure-resistance of all 18 photographic material samples were examined in the same manner as in Example 1.

The reflection density of each of the thus processed samples was measured to obtain the characteristic curve. Sensitivity, the latent image storability and the pressure-resistance of the samples were measured or evaluated in the same way as in Example 1. The results are shown in Table 5 below.

TABLE 5

| Emulsion/ Sample | Compound Added | Amount Added | 10-second exposure Sensitivity | 10-second exposure Gradation | $10^{-2}$-second exposure Sensitivity | $10^{-2}$-second exposure Gradation | Latent Image Storability | Pressure-Resistance | Remarks |
|---|---|---|---|---|---|---|---|---|---|
| A' | — | — | 100 | 1.24 | 80 | 1.03 | −0.03 | ○ | Comparison |
| B' | $K_3Fe(CN)_6$ | $1 \times 10^{-6}$ | 115 | 1.22 | 105 | 1.07 | −0.01 | Δ | Comparison |
| C' | $K_3Fe(CN)_6$ | $1 \times 10^{-5}$ | 125 | 1.14 | 115 | 1.04 | +0.03 | X | Comparison |
| D' | $K_3Fe(CN)_6$ | $1 \times 10^{-4}$ | 160 | 0.97 | 155 | 0.85 | +0.05 | X | Comparison |
| E' | $K_4Ru(CN)_6$ | $1 \times 10^{-6}$ | 120 | 1.22 | 115 | 1.14 | +0.02 | Δ | Comparison |
| F' | $K_3Ru(CN)_6$ | $1 \times 10^{-5}$ | 135 | 1.20 | 125 | 1.12 | +0.05 | X | Comparison |
| G' | $K_4Ru(CN)_6$ | $1 \times 10^{-4}$ | 140 | 1.15 | 135 | 1.10 | +0.10 | X | Comparison |
| H' | $K_3IrCl_6$ | $2 \times 10^{-8}$ | 90 | 1.25 | 88 | 1.15 | +0.05 | ○ | Comparison |
| I' | $K_3IrCl_6$ | $4 \times 10^{-8}$ | 80 | 1.28 | 81 | 1.24 | +0.17 | ○ | Comparison |
| J' | $K_3IrBr_6$ | $4 \times 10^{-8}$ | 75 | 1.17 | 75 | 1.15 | +0.25 | ○ | Comparison |
| K' | $K_2PtCl_4$ | $1 \times 10^{-5}$ | 95 | 1.24 | 83 | 1.09 | +0.01 | ○ | Comparison |
| L' | $K_2PtCl_4$ | $1 \times 10^{-4}$ | 90 | 1.22 | 80 | 1.06 | +0.02 | ○ | Comparison |
| M' | $K_3Ir(CN)_6$ | $5 \times 10^{-7}$ | 120 | 1.26 | 113 | 1.20 | ±0.00 | ○ | Invention |
| N' | $K_3Ir(CN)_6$ | $1 \times 10^{-6}$ | 130 | 1.28 | 125 | 1.22 | +0.01 | ○ | Invention |
| O' | $K_3Ir(CN)_6$ | $1 \times 10^{-5}$ | 135 | 1.30 | 135 | 1.29 | +0.01 | ○ | Invention |
| P' | $K_3Ir(CN)_6$ | $1 \times 10^{-4}$ | 135 | 1.30 | 135 | 1.30 | +0.02 | ○ | Invention |
| Q' | $K_2Pt(CN)_4$ | $1 \times 10^{-4}$ | 130 | 1.24 | 125 | 1.23 | −0.02 | ○ | Invention |
| R' | $K_2Pt(CN)_4$ | $5 \times 10^{-4}$ | 125 | 1.25 | 125 | 1.24 | −0.01 | ○ | Invention |

Amount added is represented by the number of mols per mol of silver halide.
Sensitivity is represented as a relative value to the sensitivity of 10-second exposed Sample (A') of 100.
Where the value of gradation is larger, the sample is harder.
Where the absolute value of the latent image storbility is smaller, the sample is more stable.

As is obvious from the results shown in Table 5 above, Samples (B'), (C') and (D') having $K_3Fe(CN)_6$-added emulsion had a poor pressure-resistance although they had a high sensitivity. In particular, Sample (D') containing a large amount of the additive was noted to be extremely softened. Samples (E'), (F') and (G') to which $K_4Ru(CN)_6$ had been added also had a poor pressure-resistance, although they were not softened as much even though the amount of the additive was large. Also, Samples (F') and (G') containing a large amount of the additive had a worsened latent image storability. Samples (H'), (I'), (J'), (K') and (L') to which $K_3IrCl_6$, $K_3IrBr_6$ or $K_2PtCl_4$ had been added did not have an elevated sensitivity; and Samples (H'), (I') and (J') to which $K_3IrCl_6$ or $K_3IrBr6$ had been added had an extremely poor latent image storability.

In contrast, Samples (M'), (N'), (O'), (P'), (Q') and (R') of the present invention to which $K_3Ir(CN)_6$ or $K_2Pt(CN)_6$ had been added had an improved sensitivity without worsening the pressure-resistance and the latent image storability. Additionally, these samples of the present invention had little fluctuation of the sensitivity and gradation where the intensity of the light to be applied thereto for exposure varied. The same results were obtained when $Re(CN)_6^{4-}$ was added instead of $Ru(CN)_6^{4-}$.

EXAMPLE 6

Three kinds of gelatin powders (#1 to #3) each having the transmittance as indicated in Table 6 below were prepared. 32 g of #1 gelatin was added to 800 cc of distilled water and dissolved at 40° C., then 3.3 g of sodium chloride was added thereto, and the solution was heated up to 60° C. 1.8 cc of N,N'-dimethylimidazolidine-2-thione (1% aqueous solution) was added to the resulting solution. Subsequently, a solution of 32.0 g of silver nitrate dissolved in 200 cc of distilled water and a solution of 11.0 g of sodium chloride dissolved in 200 cc of distilled water were added to and blended with the previously prepared solution at 60° C. over a period of 14 minutes.

Next, a solution of 128,0 g of silver nitrate dissolved in 560 cc of distilled water and a solution of 44.0 g of sodium chloride dissolved in 560 cc of distilled water were further added and blended therewith at 60° C. over a period of 40 minutes. The resulting blend was de-salted and washed with water at 40° C., and 90.0 g of lime-processed gelatin was added to the washed blend, which was then adjusted to a pAg value of 8.0 and a pH value of 7.2 by adding sodium chloride and sodium hydroxide thereto.

After this was heated up to 50° C., $8 \times 10^{-5}$ mol per mol of silver halide of the same red-sensitizing dye as that used in Example 5 was added thereto. Then, an emulsion of ultra-fine silver bromide grains (having grain size of 0.05 micron) was added thereto in an amount of 0.6 mol % as silver bromide content, and the resulting emulsion blend was ripened for 15 minutes. This was sulfur-sensitized with triethylthiourea at 50° C. After sulfur-sensitization, $5 \times 10^{-4}$ mol per mol of silver halide of Compound (I-1) was added thereto. The silver chloride emulsion thus obtained was called Emulsion (S').

TABLE 6

| Gelatin Powder | Characteristic of Gelatin | Transmittance |
|---|---|---|
| #1 | Alkali-processed gelatin derived from bovine bone. | 47% |
| #2 | Gelatin #1 was purified by treatment with active charcoal. | 76% |
| #3 | Gelatin #1 was purified by washing with cold water followed by treatment with active charcoal. | 83% |

Another silver chlorobromide emulsion (Emulsion (T')) was prepared in the same manner as in preparation of silver chlorobromide emulsion (Emulsion (S')), except that an aqueous solution containing $3 \times 10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (U')) was prepared in the same manner as in preparation of Emulsion (S'), except that gelatin #1 to be used in formation of silver chloride grains was replaced by gelatin #2.

Another silver chlorobromide emulsion (Emulsion (V')) was prepared in the same manner as in preparation of Emulsion (U'), except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another emulsion (Emulsion (W')) was prepared in the same manner as in preparation of Emulsion (S'), except that gelatin #1 to be used in formation of silver chloride grains was replaced by gelatin #3.

Another silver chlorobromide emulsion (Emulsion (X')) was prepared in the same manner as in preparation of Emulsion (W'), except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 40 minutes.

Another silver chlorobromide emulsion (Emulsion (Y')) was prepared in the same manner as in preparation of Emulsion (W'), except that $7\times10^{-4}$ mol per mol of silver halide of 4-hydroxy-6-methyl-1,3,3a,7-tetrazaindene (TAI) was added after sulfur-sensitization in place of compound (I-1).

Another silver chlorobromide emulsion (Emulsion (Z')) was prepared in the same manner as in preparation of Emulsion (Y'), except that an aqueous solution containing $3\times10^{-5}$ mol per mol of silver halide of $K_3Ir(CN)_6$ was added to the reaction system along with the second addition of aqeuous silver nitrate solution and aqueous sodium chloride solution thereto over a period of 40 minutes.

Another silver chlorobromide emulsion (Emulsion (a')) was prepared in the same manner as in preparation of Emulsion (W'), except that $8\times10^{-4}$ mol per mol of silver halide of compound (II-1) was added in place of compound (I-1) after gold-sulfur-sensitization which was carried out in the same way as in Example 1.

Another silver chlorobromide emulsion (Emulsion (b')) was prepared in the same manner as in preparation of Emulsion (a'), except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 40 minutes.

The grain shape, grain size and grain size distribution of each of these 10 emulsions (Emulsions (S') to (b')) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 10 emulsions (Emulsions (S') to (b')) contained cubic grains with very sharp edges, having a grain size of 0.54 micron and a grain size distribution of from 0.09. The X-ray diffraction curve of each of Emulsions (S') to (b') showed a weak diffraction at the part corresponding to the silver bromide content of from 10 mol % to 40 mol %. From the facts, it is determined that the grains in these emulsions were cubic silver chloride grains having a silver bromide-rich localized phase (having a silver bromide content of from 10 mol % to 40 mol %) on the corners of the grain as grown thereon by epitaxial growth.

Photographic material samples (Samples (S') to (b')) were prepared in the same manner as in preparation of Sample (A') in Example 5, except that the emulsion in the fifth layer (red-sensitive emulsion layer) was replaced by anyone of the emulsions as indicated in Table 7 below and that potassium bromide was added to the coating composition of the fifth layer (red-sensitive emulsion layer) in an amount of 0.3 mol % per mol of silver in the red-sensitive emulsion.

The sensitivity, gradation, latent image storability and pressure-resistance of each of the 10 samples were evaluated in the same manner as in Example 1. However, exposure of the samples was effected through a red filter. The results obtained are shown in Table 7 below.

TABLE 7

| Emulsion/ Sample | Gelatin Used in Formation of Grains | Compound Added after Chemical Sensitization | Addition of $K_3IrCN_6$ | 10-second exposure | | $10^{-2}$-second exposure | | Latent Image Storability | Pressure Resistance | Remarks |
|---|---|---|---|---|---|---|---|---|---|---|
| | | | | Sensitivity | Gradation | Sensitivity | Gradation | | | |
| S' | #1 | (I-1) | No | 100 | 1.27 | 80 | 1.03 | −0.03 | ○ | Comparison |
| T' | #1 | (I-1) | Yes | 130 | 1.20 | 125 | 1.00 | −0.06 | Δ | Invention |
| U' | #2 | (I-1) | No | 105 | 1.30 | 85 | 1.13 | −0.05 | ○ | Comparison |
| V' | #2 | (I-1) | Yes | 135 | 1.25 | 130 | 1.20 | −0.02 | ○ | Invention |
| W' | #3 | (I-1) | No | 115 | 1.35 | 95 | 1.25 | −0.06 | ○ | Comparison |
| X' | #3 | (I-1) | Yes | 150 | 1.35 | 150 | 1.33 | −0.01 | ○ | Invention |
| Y' | #3 | (TAI) | No | 110 | 1.26 | 90 | 1.15 | −0.05 | ○ | Comparison |
| Z' | #3 | (TAI) | Yes | 140 | 1.23 | 130 | 1.18 | −0.03 | ○ | Invention |
| a' | #3 | (II-1) | No | 110 | 1.33 | 105 | 1.26 | −0.06 | ○ | Comparison |
| b' | #3 | (II-1) | Yes | 145 | 1.32 | 145 | 1.30 | −0.01 | ○ | Invention |

Sensitivity is represented as a relative value to the sensitivity of 10-second exposed Sample S' of 100.
Where the value of gradation is larger, the sample is harder.
Where the absolute value of the latent image storbility is smaller, the sample is more stable.

As is obvious from the results in Table 7 above, in the high silver chloride emulsions having a silver bromide-rich localized phase with a silver bromide content of 10 mol % or more, the increase of the sensitivity caused by addition of $K_3Ir(CN)_6$ is and the effect of the additive for preventing the fluctuation of the sensitivity and gradation caused by variation of the intensity of the light for exposure is noted.

However, these effects depend upon the kind of gelatin as used in formation of silver chloride grains. Where a gelatin having a higher transmittance is used, the increase of the sensitivity caused by addition of $K_3Ir(CN)_6$ was higher and the effect of the additive for preventing the fluctuation of the sensitivity and gradation caused by variation of the intensity of the light for exposure was more remarkable. Additionally, latent image fading was less in this case. These effects were further augmented in the samples in which compound (I-1) or (II-1) had been added to the red-sensitive emulsion.

EXAMPLE 7

32 g of lime-processed gelatin was added to 800 cc of distilled water and dissolved at 40° C., then 5.7 g of sodium chloride was added thereto, and the solution was heated up to 75° C. 1.8 cc of N,N'-dimethylimidazolidine-2-thione (1% aqueous solution) was added to the resulting solution. Subsequently, a solution of 100 g of silver nitrate dissolved in 400 cc of distilled water and a solution of 34.4 g of sodium chloride dissolved in 400 cc of distilled water were added to and blended with the previously prepared solution at 75° C. over a period of 53 minutes.

Next, a solution of 60 g of silver nitrate dissolved in 200 cc of distilled water and a solution of 17.4 g of sodium chloride dissolved in 200 cc of distilled water were further added and blended therewith at 75° C. over a period of 18 minutes. The resulting blend was de-salted and washed with water at 40° C., and 90.0 g of lime-processed gelatin was added to the washed blend, which was then adjusted to have a pAg value of 7.5 and a pH value of 6.5 by adding sodium chloride and sodium hydroxide thereto.

After $3\times10^{-4}$ mol per mol of silver halide of the same blue-sensitizing dye as that used in Example 5 was added thereto, this was optimally sulfur-sensitized with triethylthiourea. After sulfur sensitization, $3\times10^{-4}$ mol per mol of silver halide of Compound (I-1) was added thereto. The silver chloride emulsion thus obtained was called Emulsion (c').

Another silver chloride emulsion (Emulsion (d')) was prepared in the same manner as in preparation of Emulsion (c'), except that an aqueous solution containing $3\times10^{5}$ mol per mol of silver halide of $K_3Ir(CN)_6$ was added to the reaction system along with the second addition of aqueous silver nitrate solution and aqueous sodium chloride solution thereto over a period of 18 minutes.

Another silver chlorobromide emulsion (Emulsion (e')) was prepared also in the same manner as in preparation of Emulsion (c') except that an additional emulsion of ultra-fine silver bromide grains (having a grain size of 0.05 micron) was added to the emulsion, prior to sulfur sensitization thereof, in an amount of 0.3 mol % as silver bromide, at 58° C., then ripened for 15 minutes, and thereafter the resulting emulsion was optimally gold-sulfur-sensitized in the same way as in Example 1.

Another silver chlorobromide emulsion (Emulsion (f')) was prepared also in the same manner as in preparation of Emulsion (e') except that an aqueous solution containing $3\times10^{-5}$ mol per mol of silver halide of $K_3Ir(CN)_6$ was added to the reaction system along with the second addition of aqueous silver nitrate solution and aqueous sodium chloride solution thereto over a period of 18 minutes.

Other silver chlorobromide emulsions (Emulsions (g'), (i') and (k')), each having a silver bromide content of 4 mol %, 18 mol % and 25 mol %, respectively, were prepared in the same manner as in preparation of Emulsion (c') except that potassium bromide was incorporated into both sodium chloride solutions for the first and second addition. However, in order that the grain size of these emulsions (Emulsions (g'), (i') and (k')) was made same as that of Emulsion (c)', the amount of N,N'-dimethylimidazolidine-2-thione to be added and the temperature in formation of the grains were suitably varied.

Other silver chlorobromide emulsions (Emulsions (h'), (j') and (l') were prepared in the same manner as in preparation of Emulsions (g'), (I') and (k'), respectively, except that an aqueous solution containing $3\times10^{31\,5}$ mol per mol of silver halide of $K_3Ir(CN)_6$ was added to the reaction system along with the second addition of aqueous silver nitrate solution and aqueous sodium chloride solution thereto over a period of 18 minutes.

The grain shape, grain size and grain size distribution of each of these 10 emulsions (Emulsions (c') to (l')) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 10 emulsions (Emulsions (c') to (l')) contained cubic grains, having a grain size of 0.82 micron and a grain size distribution of from 0.10 to 0.12.

It was noted from the electronic microscopic photographs that the grains in Emulsions (e') and (f') to which ultra-fine silver bromide grains had been added were sharper on every corner edge than those in Emulsions (c') and (d') to which such grains had not been added. The X-ray diffraction curve of each of Emulsions (e') and (f') showed a weak diffraction at the part corresponding to the silver bromide content of from 10 mol % to 40 mol %. From the facts, it is determined that the grains in Emulsions (e') and (f') were cubic silver chloride grains having a silver bromide-rich localized phase (having a silver bromide content of from 10 mol % to 40 mol %) on the corners of the grain as grown thereon by epitaxial growth.

In contrast, in the X-ray diffraction curve of each of the other emulsions (Emulsions (g') to (l')), any peak than the strong diffraction peak corresponding to the mean silver bromide content was not noted. That is, it is determined that the grains of these emulsions did not have the localized phase as defined hereinabove.

Photographic material samples (Samples (c') to (l')) were prepared in the same manner as in preparation of Sample (A') in Example 5, except that the emulsion in the first layer (blue-sensitive emulsion layer) was replaced by anyone of the emulsions prepared above (Emulsions (c') to (l'), respectively) as indicated in Table 8 below.

The sensitivity, gradation, latent image storability and pressure-resistance of each of the 10 samples were evaluated in the same manner as in Example 5. The results obtained are shown in Table 8 below.

TABLE 8

| Emulsion/ Sample | AgBr Content (mol %) | Addition of $K_3IrCN_6$ | 10-second exposure | | $10^{-2}$-second exposure | | Latent Image Storability | Pressure-Resistance | Remarks |
|---|---|---|---|---|---|---|---|---|---|
| | | | Sensitivity | Gradation | Sensitivity | Gradation | | | |
| c' | 0 | No | 100 | 1.28 | 72 | 1.02 | −0.04 | ○ | Comparison |
| d' | 0 | Yes | 110 | 1.30 | 80 | 1.05 | +0.01 | ○ | Comparison |

TABLE 8-continued

| Emulsion/ Sample | AgBr Content (mol %) | Addition of $K_3IrCN_6$ | 10-second exposure Sensitivity | 10-second exposure Gradation | $10^{-2}$-second exposure Sensitivity | $10^{-2}$-second exposure Gradation | Latent Image Storability | Pressure-Resistance | Remarks |
|---|---|---|---|---|---|---|---|---|---|
| e' | 0.3 | No | 170 | 1.36 | 130 | 1.10 | −0.05 | ○ | Comparison |
| f' | 0.3 | Yes | 225 | 1.38 | 222 | 1.36 | +0.01 | ○ | Invention |
| g' | 4 | No | 120 | 1.26 | 96 | 1.12 | −0.07 | ○ | Comparison |
| h' | 4 | Yes | 140 | 1.28 | 140 | 1.26 | −0.03 | ○ | Comparison |
| i' | 18 | No | 150 | 1.16 | 125 | 1.04 | −0.07 | ○ | Comparison |
| j' | 18 | Yes | 175 | 1.16 | 170 | 1.12 | −0.04 | ○ | Comparison |
| k' | 25 | No | 140 | 1.19 | 125 | 1.03 | −0.08 | ○ | Comparison |
| l' | 25 | Yes | 145 | 1.17 | 130 | 1.05 | −0.07 | ○ | Comparison |

Sensitivity is represented as a relative value to the sensitivity of 10-second exposed Sample (c') of 100.
Where the value of gradation is larger, the sample is harder.
Where the absolute value of the latent image storability is smaller, the sample is more stable.

As is obvious from the results in Table 8 above, in the emulsion having a high silver bromide content (Emulsion (l')) or in the emulsions having a low silver bromide content but having no localized phase (Emulsions (h') and (j') or in the pure silver chloride emulsion (Emulsion (d')), the increase of the sensitivity caused by addition of $K_3Ir(CN)_6$ and the effect of the additive for preventing the fluctuation of the sensitivity and gradation caused by variation of the intensity of the light for exposure was noted. However, the effects were not so great.

In contrast, in the emulsion (Emulsion (f')) having a low silver bromide content and having a localized phase with a silver bromide content of 10 mol % or more, the elevation of the sensitivity caused by addition of $K_3Ir(CN)_6$ was great and the effect by the additive of preventing the fluctuation of the sensitivity and gradation to be caused by variation of the intensity of the light for exposure was also great. Additionally, in the last emulsion, latent image fading was reduced.

EXAMPLE 8

25 g of lime-processed gelatin was added to 800 cc of distilled water and dissolved at 40° C., then 2.25 g of sodium chloride was added thereto, and the solution was heated up to 70° C. Subsequently, a solution of 5.0 g of silver nitrate dissolved in 140 cc of distilled water and a solution of 1.7 g of sodium chloride dissolved in 140 cc of distilled water were added to and blended with the previously prepared solution at 70° C. over a period of 40 minutes.

Next, a solution of 120 g of silver nitrate dissolved in 320 cc of distilled water and a solution of 41.3 g of sodium chloride dissolved in 320 cc of distilled water were further added and blended therewith at 70° C. over a period of 80 minutes. The resulting blend was de-salted and washed with water at 40° C., and 76.0 g of lime-processed gelatin was added to the washed blend, which was then adjusted to a pAg value of 7.9 and a pH value of 6.2 by adding sodium chloride and sodium hydroxide thereto.

After this was heated up to 58° C., $3\times10^{-4}$ mol per mol of silver halide of the same blue-sensitizing dye as that used in Emulsion A in Example 5 was added thereto. Then an emulsion of ultra-fine silver bromide grains (having a mean grain size of 0.05 micron) was added thereto in an amount of 0.3 mol % as silver bromide content to silver chloride, and the resulting emulsion blend was ripened for 15 minutes. This was sulfur-sensitized with triethylthiourea.

After sulfur sensitization, $3\times10^{-4}$ mol per mol of silver halide of Compound (I-1) was added thereto. The silver chlorobromide emulsion thus obtained was called Emulsion (m').

Another silver chlorobromide emulsion (Emulsion (n')) was prepared in the same manner as in preparation of Emulsion (m'), except that an aqueous solution of $5\times10^{-5}$ mol per mol of silver halide of $K_3Ir(CN)_6$ was added to the reaction system during the course of from initiation of addition of the aqueous silver nitrate solution to finish of addition of the same at a speed always having a constant rate relative to the concentration of the silver nitrate in the reaction system. It is considered that the resulting emulsion (Emulsion (n')) contained $[Ir(CN)_6]^{-3}$ almost uniformly in the grains.

Another silver chlorobromide emulsion (Emulsion (o')) was prepared in the same manner as in preparation of Emulsion (m'), except that an aqueous solution of $5\times10^{-5}$ mol per mol of silver halide of $K_3Ir(CN)_6$ was added to the reaction system during the course ranging from initiation of the addition of the aqueous silver nitrate solution to the time by which 50% of the whole amount of silver nitrate was added, at a speed always having a constant rate relative to the concentration of the silver nitrate in the reaction system.

Another silver chlorobromide emulsion (Emulsion (p')) was prepared in the same manner as in preparation of Emulsion (m'), except that an aqueous solution of $5\times10^{-5}$ mol of silver halide of $K_3Ir(CN)_6$ was added to the reaction system after 4% of the whole amount of silver nitrate had been added to the reaction system and before 54% of the whole amount of the same was added thereto, at a speed always having a constant rate relative to the concentration of the silver nitrate in the reaction system.

Another silver chlorobromide emulsion (Emulsion (q')) was prepared in the same manner as in preparation of Emulsion (m'), except that an aqueous solution of $5\times10^{-5}$ mol per mol of silver halide of $K_3Ir(CN)_6$ was added to the reaction system after 4% of the whole amount of silver nitrate had been added to the reaction system and before completion of addition of all silver nitrate thereto, at a speed always having a constant rate relative to the concentration of the silver nitrate in the reaction system.

Another silver chlorobromide emulsion (Emulsion (r')) was prepared in the same manner as in preparation of Emulsion (m'), except that an aqueous solution of $5\times10^{-5}$ mol per mol of silver halide of $K_3Ir(CN)_6$ was added to the reaction system after 50% of the whole amount of silver nitrate had been added to the reaction system and before 80% of the whole amount of the same was added thereto, at a speed always having a constant rate relative to the concentration of the silver nitrate in the reaction system.

Another silver chlorobromide emulsion (Emulsion (s')) was prepared in the same manner as in preparation of Emulsion (m'), except that an aqueous solution of $5\times10^{-5}$ mol per mol of silver halide of $K_3Ir(CN)_6$ was added to the reaction system after 50% of the whole amount of silver nitrate had been added to the reaction system and before completion of addition of all silver nitrate thereto, at a speed always having a constant rate relative to the concentration of the silver nitrate in the reaction system.

Another silver chlorobromide emulsion (Emulsion (t')) was prepared in the same manner as in preparation of Emulsion (m'), except that an aqueous solution of $5\times10^{-5}$ mol per mol of silver halide of $K_3Ir(CN)_6$ was added to the reaction system after 80% of the whole amount of silver nitrate had been added to the reaction system and before completion of addition of all silver nitrate thereto, at a speed always having a constant rate relative to the concentration of the silver nitrate in the reaction system.

The grain shape, grain size and grain size distribution of each of these 8 emulsions (Emulsions (m') to (t')) thus prepared were obtained from their electronic microscopic photographs. The grain size was represented by the mean value of the diameter of the circle having the same area as the projected area of the grain; and the grain size distribution was represented by the value as obtained by dividing the standard deviation of the grain size by the mean grain size. All 8 emulsions (Emulsions (m') to (t')) contained cubic grains with very sharp edges, having a grain size of 0.92 micron and a grain size distribution of from 0.11. The X ray diffraction curve of each of these emulsions showed a weak diffraction at the part corresponding to the silver bromide content of from 10 mol % to 40 mol %. From the facts, it is determined that the grains in these emulsions were cubic silver chloride grains having a silver bromide-rich localized phase (having a silver bromide content of from 10 mol % to 40 mol %) on the corners of the grain as grown thereon by epitaxial growth.

Photographic material samples (Samples (m') to (t')) were prepared in the same manner as in preparation of Sample (A') in Example 5, except that the emulsion in the first layer (blue-sensitive emulsion layer) was replaced by any one of the emulsions prepared above (Emulsions (m') to (t'), respectively) as indicated in Table 9 below.

The sensitivity, gradation, latent image storability and pressure-resistance of each of the 8 samples were evaluated in the same manner as in Example 1. The results obtained are shown in Table 9 below.

As is obvious from the results in Table 9 above, in the emulsions (Emulsions (o') and (p')) where $K_3Ir(CN)_6$ had been incorporated into the grains only in the vicinity of the center of the grain, the increase of the sensitivity caused by addition of $K_3Ir(CN)6$ was not satisfactorily large and the effect of the additive for preventing the fluctuation of the sensitivity and gradation caused by variation of the intensity of the light for exposure was also not satisfactorily large. In addition, the pressure-resistance of such emulsions was somewhat lowered.

In contrast, in the other emulsions (Emulsions (r'), (s') and (t')) where $K_3Ir(CN)_6$ had been incorporated into the grains in the vicinity of the surface layer of the grain, the elevation of the and the effect of the additive for preventing the fluctuation of the sensitivity and gradation caused by variation of the intensity of the light for exposure was also great, without worsening the pressure-resistance. Accordingly, it is noted that the latter emulsions (Emulsions (r'), (s') and (t')) are more preferred embodiments of the present invention.

As is obvious from the explanation mentioned above, there is provided in accordance with the present invention a silver halide photographic material which has an excellent rapid processability and a high sensitivity. The material is free from fluctuation of sensitivity gradation caused by variation of the intensity of the light to be applied thereto for exposure and is also free from fluctuation of sensitivity caused by variation of the time from exposure to processing. The material is hardly fogged under pressure.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one light-sensitive emulsion layer containing a silver halide emulsion on a support, wherein the light-sensitive emulsion layer comprises silver halide grains which contain at least one complex selected from the group consisting of Ir and Pt metal complexes having at least two cyano ligands, which have a silver chloride content of 80 mol % or more and which are gold-sensitized.

2. The silver halide photographic material as in claim 1, wherein the light-sensitive emulsion layer contains at least one compound selected from the group consisting of compounds of general formulae (I), (II) and (III):

TABLE 9

| Emulsion/ Sample | Addition of of $K_3IrCN_6$ (%) Start | Finish | 10-second exposure Sensitivity | Gradation | $10^{-2}$-second exposure Sensitivity | Gradation | Latent Image Storability | Pressure-Resistance | Remarks |
|---|---|---|---|---|---|---|---|---|---|
| m' | — | — | 100 | 1.27 | 83 | 1.04 | −0.04 | ○ | Comparison |
| n' | 0 | 100 | 125 | 1.24 | 122 | 1.20 | +0.01 | ○ | Invention |
| o' | 0 | 50 | 125 | 1.23 | 120 | 1.18 | −0.01 | Δ | Invention |
| p' | 4 | 54 | 123 | 1.22 | 118 | 1.16 | −0.01 | Δ | Invention |
| q' | 4 | 100 | 125 | 1.24 | 124 | 1.23 | +0.01 | ○ | Invention |
| r' | 50 | 80 | 130 | 1.28 | 128 | 1.25 | +0.01 | ○ | Invention |
| s' | 50 | 100 | 135 | 1.29 | 133 | 1.27 | +0.01 | ○ | Invention |
| t' | 80 | 100 | 140 | 1.32 | 140 | 1.32 | +0.01 | ○ | Invention |

The amount of $K_3IrCN_6$ added at the start of addition and at the finish thereof was represented by the percentage (%) with respect to the total amount of silver nitrate used for formation of grains. (Accordingly, Samples (r') and (s') contained $K_3IrCN_6$ in the surface layer of 50% or less of the volume of the grain, and Sample (t') contained $K_3IrCN_6$ in the surface layer of 20% or less of the same.)

Sensitivity was represented as a relative value to the sensitivity of 10-second exposed Sample (m') of 100.

Where the value of gradation is larger, the sample is harder.

Where the absolute value of the latent image storability is smaller, the sample is more stable.

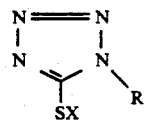

(I)

where R represents an alkyl group, an alkenyl group, or an aryl group; and X represents a hydrogen atom, an alkali metal atom, an ammonium group, or a precursor;

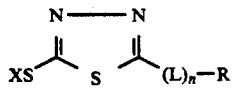

(II)

where L represents a divalent linking group: R represents a hydrogen atom, an alkyl group, an alkenyl group, or an aryl group; and X has the same meaning as that in formula (I); n represents 0 or 1; and

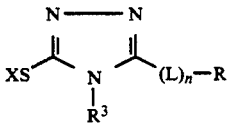

(III)

where R and X have the same meanings as those in formula (I): L has the same meaning as that in formula (II): and R3 has the same meaning as R and they may be same as or different from each other; and n represents 0 or 1.

3. The silver halide photographic material as in claim 1, wherein the total content of at least one complex selected from the group consisting of Ir and Pt metal complexes having at least two cyano ligands in the silver halide grains is from about $1\times10^{-6}$ mol to about $1\times10^{-3}$ mol per mol of silver halide in the grains.

4. The silver halide photographic material as in claim 3, wherein the total content is from $5\times10^{-6}$ mol to the $5\times10^{-4}$ mol per mol of silver halide.

* * * * *